US011591875B2

(12) United States Patent
Godfrey et al.

(10) Patent No.: US 11,591,875 B2
(45) Date of Patent: Feb. 28, 2023

(54) LINER RETRIEVAL TOOL AND METHOD

(71) Applicant: Enventure Global Technology, Inc., Houston, TX (US)

(72) Inventors: Matthew Mark Godfrey, Katy, TX (US); Eric James Connor, Katy, TX (US); Jesse Ortiz, Cypress, TX (US)

(73) Assignee: Enventure Global Technology Inc.

( * ) Notice: Subject to any disclaimer, the term of this patent is extended or adjusted under 35 U.S.C. 154(b) by 19 days.

(21) Appl. No.: 17/316,206

(22) Filed: May 10, 2021

(65) Prior Publication Data

US 2021/0348463 A1 Nov. 11, 2021

Related U.S. Application Data

(60) Provisional application No. 63/023,101, filed on May 11, 2020.

(51) Int. Cl.

| | |
|---|---|
| ***E21B 23/14*** | (2006.01) |
| ***E21B 23/10*** | (2006.01) |
| ***E21B 43/10*** | (2006.01) |
| ***E21B 43/08*** | (2006.01) |

(52) U.S. Cl.

CPC ..... *E21B 23/14* (2013.01); *E21B 23/10* (2013.01); *E21B 43/08* (2013.01); *E21B 43/10* (2013.01); *E21B 43/103* (2013.01); *E21B 43/105* (2013.01)

(58) Field of Classification Search

CPC ..... E21B 23/10; E21B 43/08; E21B 43/10; E21B 43/103; E21B 43/105

See application file for complete search history.

(56) References Cited

U.S. PATENT DOCUMENTS

| | | | | |
|---|---|---|---|---|
| 3,498,376 | A * | 3/1970 | Sizer | E21B 43/105 166/207 |
| 3,669,190 | A * | 6/1972 | Sizer | E21B 23/0414 166/207 |
| 4,955,195 | A * | 9/1990 | Jones | E21B 34/16 91/32 |
| 7,306,044 | B2 * | 12/2007 | Connell | E21B 29/10 166/207 |
| 8,261,842 | B2 * | 9/2012 | Moeller | E21B 43/105 166/207 |
| 8,833,463 | B2 * | 9/2014 | Graves | E21B 7/061 166/255.3 |
| 9,206,674 | B2 * | 12/2015 | Luke | E21B 21/10 |
| 10,240,439 | B2 * | 3/2019 | Noffke | E21B 17/046 |

(Continued)

OTHER PUBLICATIONS

Search report prepared for counterpart application GB2106662.6, dated Jan. 19, 2022, 1 page.

*Primary Examiner* — Jonathan Malikasim
(74) *Attorney, Agent, or Firm* — Jonathan Pierce; Pierre Campanac; Porter Hedges LLP

(57) ABSTRACT

A string includes a pipe that is connected to an expansion mechanism and a retrieval tool that is connected to the pipe above the expansion mechanism. The retrieval tool includes a carrier that can selectively latch on an expandable liner and one or more actuators. The retrieval tool can ensure latching of the carrier while the expandable liner is above the Blow-out Preventer. The retrieval tool can prevent accidental latching of the carrier on the expandable liner during the expansion of the liner. By manipulating the pipe, the retrieval tool can force the carrier's release from the expandable liner.

12 Claims, 18 Drawing Sheets

(56) References Cited

U.S. PATENT DOCUMENTS

| | | | | |
|---|---|---|---|---|
| 2006/0196678 | A1 | 9/2006 | Connell et al. | |
| 2010/0155084 | A1 | 6/2010 | Watson et al. | |
| 2011/0024135 | A1 | 2/2011 | Noel et al. | |
| 2013/0220639 | A1* | 8/2013 | Dalia | E21B 33/06 166/384 |
| 2013/0228344 | A1 | 9/2013 | Luke | |
| 2018/0002997 | A1 | 1/2018 | Godfrey et al. | |

* cited by examiner

Fig. 6H
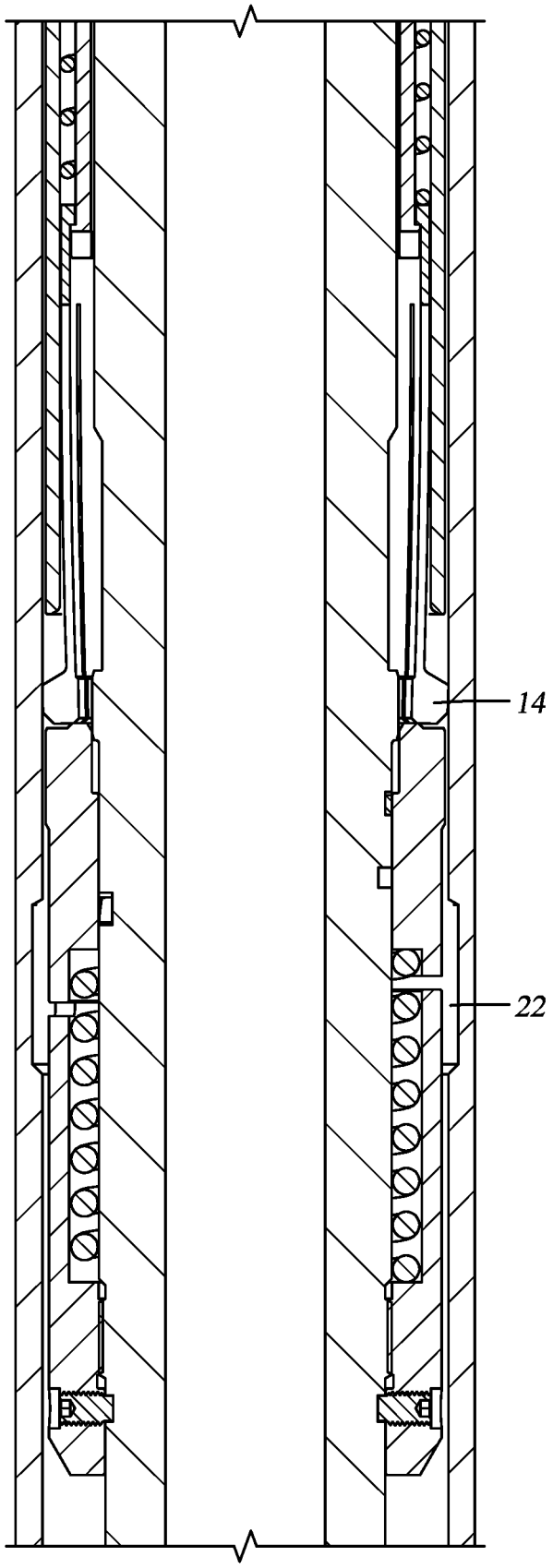
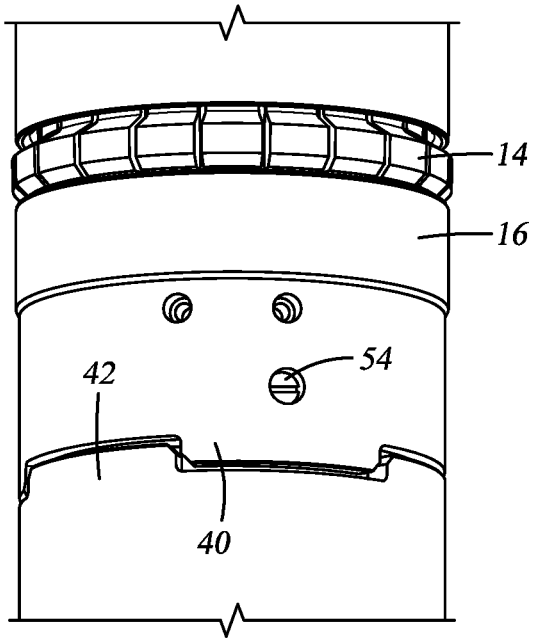
Fig. 6G

LINER RETRIEVAL TOOL AND METHOD

CROSS-REFERENCE TO RELATED APPLICATIONS

This application claims the benefit of priority to U.S. provisional application Ser. No. 63/023,101 filed on May 11, 2020, the content of which is incorporated herein by reference for all and any purposes.

BACKGROUND

The disclosure relates generally to a method of deploying an expandable liner in a well, and a system for deploying an expandable liner in a well. The disclosure relates more particularly to methods and systems in which a liner retrieval tool includes a carrier having latch and release positions for selectively holding the expandable liner on the liner retrieval tool, and one or more actuators, each having armed and disarmed positions for controlling the movement of the carrier.

SUMMARY

The disclosure describes a method of deploying an expandable liner in a well.

The method may comprise the step of providing a string. The string may include a pipe that is connected to an expansion mechanism. The expansion mechanism may include an expansion cone. The expansion cone may support the expandable liner around the pipe. The string may also include a retrieval tool that is connected to the pipe above the expansion mechanism.

The retrieval tool may include a carrier. The carrier may have a first portion that is connected to one of the retrieval tool or the expandable liner. The carrier may also have a second portion that is movable between a latch position, wherein a contact force between the second portion and the other of the retrieval tool or the expandable liner is sufficiently large for holding the expandable liner on the retrieval tool, and a release position, wherein the contact force between the second portion and the other of the retrieval tool or the expandable liner is sufficiently small or zero so that the retrieval tool can be separated from the expandable liner. The retrieval tool may also include an actuator that is located proximate to the second portion of the carrier. The second portion may be movable. The actuator may have an armed position, wherein the actuator allows or causes the second portion to move into the latch position and hinders the second portion from leaving the latch position, and a disarmed position, wherein the actuator hinders the second portion from moving into the latch position or allows the second portion to leave the latch position.

The method may comprise the step of lowering, while the actuator is in the armed position, the string including the expandable liner from a rig, through a Blow-out Preventer, and into the well. 11. The carrier may be in the release position while the string, including the expandable liner, is lowered from the rig.

The method may comprise the step of shifting the actuator into the disarmed position after the expandable liner has passed the Blow-out Preventer and the expandable liner is located below the Blow-out Preventer.

The method may comprise the step of moving the second portion of the carrier that is movable into the latch position.

The method may comprise the step of expanding at least a portion of the expandable liner with the expansion cone while the actuator is in the disarmed position.

Alternatively, the method may comprise the step of shifting the actuator into the armed position before the expandable liner passes through the Blow-out Preventer again and the expandable liner is still located below the Blow-out Preventer. The method may comprise the step of pulling the string, including the expandable liner, out of the well through the Blow-out Preventer while the actuator is in the armed position.

Alternatively again, the method may comprise the step of severing the pipe and the expandable liner with the shear rams of the Blow-out Preventer. The pipe and the expandable liner may be severed into a top portion and a bottom portion. The retrieval tool may be included in the top portion. The method may comprise the step of pulling the top portion of the pipe and the expandable liner out of the Blow-out Preventer while the actuator is in the armed position. The method may comprise the step of sealing the Blow-out Preventer above the bottom portion of the pipe and the expandable liner.

In some embodiments, the actuator may be adapted to shift into the disarmed position by hydrostatic pressure outside the pipe that is higher than a first pre-determined threshold. The first pre-determined threshold may be larger than hydrostatic pressure at the Blow-out Preventer. Optionally, the actuator may also be adapted to shift into the armed position by hydrostatic pressure outside the pipe that is lower than a second pre-determined threshold. The second pre-determined threshold may also be larger than hydrostatic pressure at the Blow-out Preventer. The first pre-determined threshold may be equal to or larger than the second pre-determined threshold.

In some embodiments, the actuator may be adapted to shift into the disarmed position when the pressure differential between inside the pipe and outside the pipe exceeds a pre-determined threshold.

The method may comprise the step of pumping fluid inside the pipe to increase the pressure inside the pipe.

In some embodiments, the actuator may be a second actuator, and the retrieval may further comprise a first actuator located proximate to the second portion of the carrier that is movable. The first actuator may have an armed position wherein the second portion is capable of moving into and remain in the latch position, and a disarmed position wherein the second portion cannot move into or cannot remain in the latch position.

The method may comprise the step of detecting that the first actuator is not in the disarmed position.

In some embodiments, the second actuator may be adapted to shift into the disarmed position when the second portion of the carrier that is movable is in the latch position. The load applied to the pipe may be cycled a pre-determined number of times.

The method may comprise the step of cycling the load applied to the pipe after detecting that the second portion of the carrier that is movable is in the latch position.

The disclosure describes a system for deploying an expandable liner in a well.

The system may comprise the pipe as described herein above.

The system may comprise the retrieval tool as described herein above.

BRIEF DESCRIPTION OF THE DRAWINGS

For a more detailed description of the embodiments of the disclosure, reference will now be made to the accompanying drawings, wherein:

FIGS. 6G and 6H are a perspective and sectional views, respectively, of a retrieval tool located inside a pup joint and including a carrier that is shown in a release position, and a mechanical actuator that is shown in a disarmed position;

DETAILED DESCRIPTION

Figure 1:
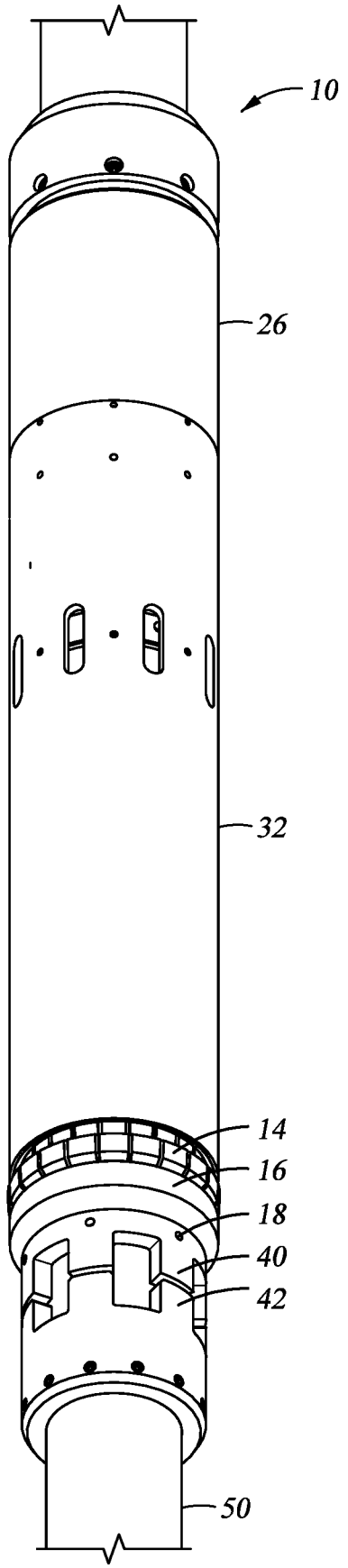
FIG. 1 is a perspective view of a retrieval tool located inside a pup joint and including a carrier and actuators.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Additionally, the disclosure may repeat reference numerals and/or letters in the various exemplary embodiments and across the FIGURES provided herein. This repetition is for the purpose of simplicity and clarity and does not in itself dictate a relationship between the various exemplary embodiments and/or configurations discussed in the various Figures. Finally, the exemplary embodiments presented below may be combined in any combination of ways, i.e., any element from one exemplary embodiment may be used in any other exemplary embodiment, without departing from the scope of the disclosure.

The disclosure describes methods of deploying a liner in a well during sub-sea operations. The liner is expandable in a bottom-up direction, as is known in the industry. The weight of the liner is carried with a pipe connected on top of an expansion assembly. The liner is held by a run-in connection at the bottom of the liner. The connection uses the face of an expansion cone or equivalent mechanism of an expansion assembly for holding the liner, as is common practice with bottom-up expandable liners. A liner retrieval tool is connected to the pipe near the top of the liner. Accordingly, the method involves providing a string that includes a pipe and an expansion mechanism connected to the pipe for expanding the liner. The expansion mechanism includes an expansion cone or equivalent. The expansion cone supports the expandable liner around the pipe. The retrieval tool illustrated in the appended Figures is connected to the pipe above the expansion mechanism.

When the rig has a sudden loss of position and moves away from the sub-sea wellhead, or some other event occurs that requires immediate separation from the subsea wellhead, the Blow-out Preventer (BoP) will typically automatically function. Casing Shear Rams (CSR) in the BoP will cut the liner and pipe but will not create a seal, as is desirable to completely shut down the well. If the liner is severed at any position below the liner retrieval tool (i.e., by the BoP), then the run-in connection at the bottom of the pipe/liner will be severed and the top portion of the severed liner is no longer held by the top portion of the severed pipe. The Blind Shear Rams (BSR) of the BoP, which are positioned above the CSR, could create a seal, but the top portion of the severed liner needs first to be moved away from the BSR to allow the BSR to close and seal. The liner retrieval tool is used to ensure that the top portion of the severed liner is moved away from the sealing BSR in the event that the BoP is functioned. Preferably, the top portion of the severed liner can be moved away from the sealing BSR automatically with no input from the rig. For example, when the operator picks up the severed pipe, the liner retrieval tool may automatically engage the top portion of the severed liner. The portion of the liner above the point at which it has been severed may be brought to the surface rather than remain in the BoP and form an obstruction to the closure of the BSR. Accordingly, the retrieval tool includes a carrier having a first portion and a second portion. The first portion is connected to one of the retrieval tool or the expandable liner. The second portion is movable between a latch position, wherein a contact force between the second portion and the other of the retrieval tool or the expandable liner is sufficiently large for holding the expandable liner on the retrieval tool, and a release position, wherein the contact force between the second portion and the other of the retrieval tool or the expandable liner is sufficiently small or zero so that the retrieval tool can be separated from the expandable liner.

During the expansion and setting of the liner, the carrier of the liner retrieval tool should not latch, because this latching could prevent the accomplishment of the normal expansion or setting procedure. In particular, it is important to reliably separate the retrieval tool from the expandable liner before or soon after beginning the expansion of the expandable liner. Otherwise, the string cannot be pulled out of the well, and the well cannot be completed. Accordingly, the carrier can be hindered from latching or can be allowed to easily release, which is also referred to herein as the actuator of the carrier being disarmed. The carrier may be disarmed by hydrostatic pressure, by the fluid pressure inside the pipe that is arising during normal liner expansion and setting procedure, and/or by mechanical manipulation of the pipe (e.g., pick up, set down, rotation). As such, the retrieval tool also includes at least one actuator located proximate to the second portion of the carrier. The actuator is movable between an armed position, wherein the actuator allows or causes the second portion to move into the latch position and hinders the second portion from leaving the latch position, and a disarmed position, wherein the actuator hinders the second portion from moving into the latch position or allows the second portion to leave the latch position. In order to add redundancy and increase the chances of successfully separating the retrieval tool from the expandable liner, the retrieval tool preferably includes a plurality of such actuators that are each movable between an armed position and a disarmed position.

FIGS. 1-6 show a first embodiment of a retrieval tool 10. In this embodiment, three actuators are provided so that, in suitable circumstances, the carrier either cannot move into the latch position or cannot remain in the latch position. The first actuator (also referred to as the hydrostatic actuator) relies on hydrostatic pressure around the pipe to move from its armed position to its disarmed position. The second actuator (also referred to as the hydraulic actuator) relies on hydraulic pressure inside the pipe to move from its armed position to its disarmed position. The third actuator (also referred to as the mechanical actuator) relies on the movement of the pipe and the retrieval tool 10 to move from its armed position to its disarmed position.

Figure 2:
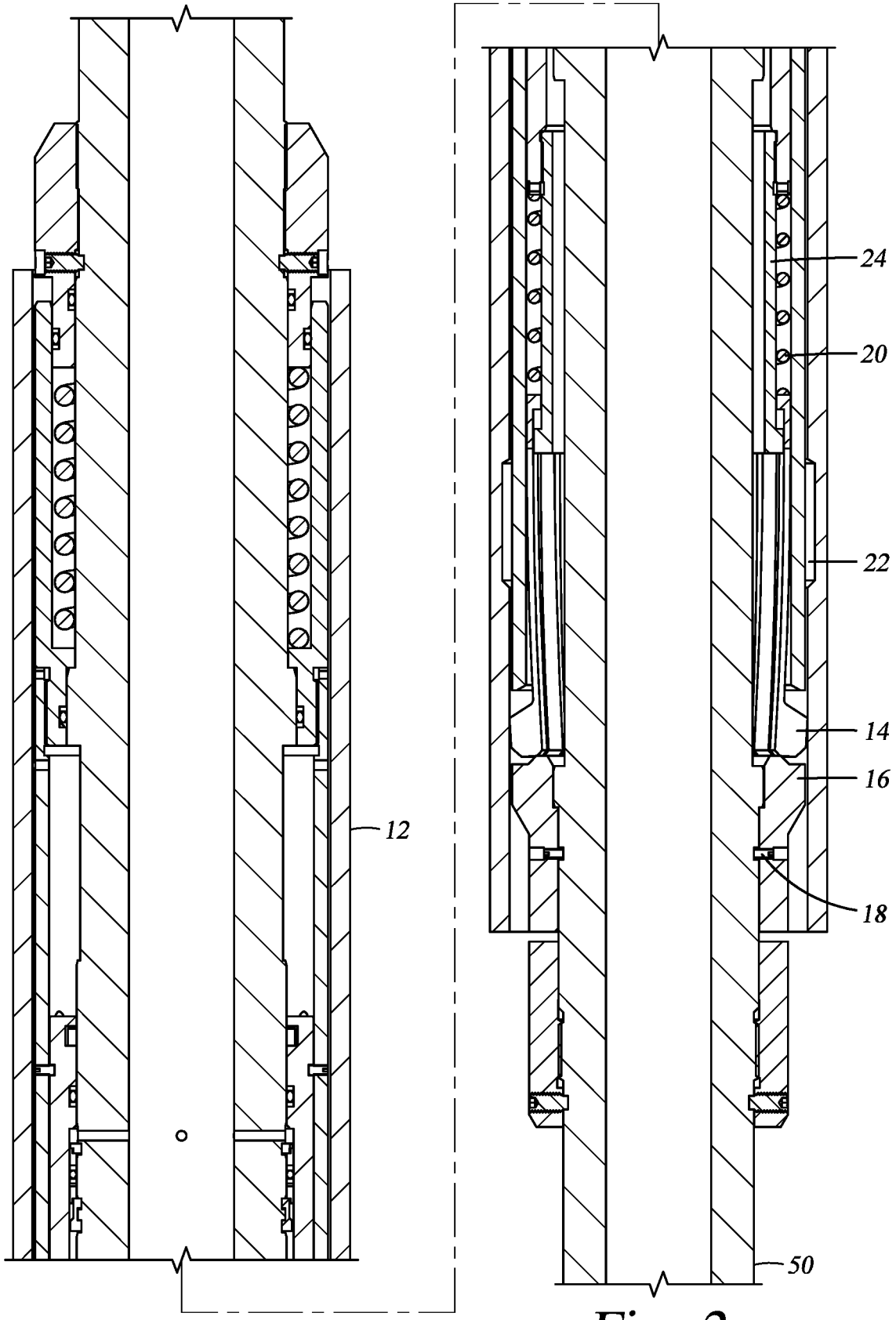
FIG. 2 is a sectional view of a retrieval tool located inside a pup joint and including a carrier that is shown in a release position and actuators that are shown in an armed position.
Figure 3:
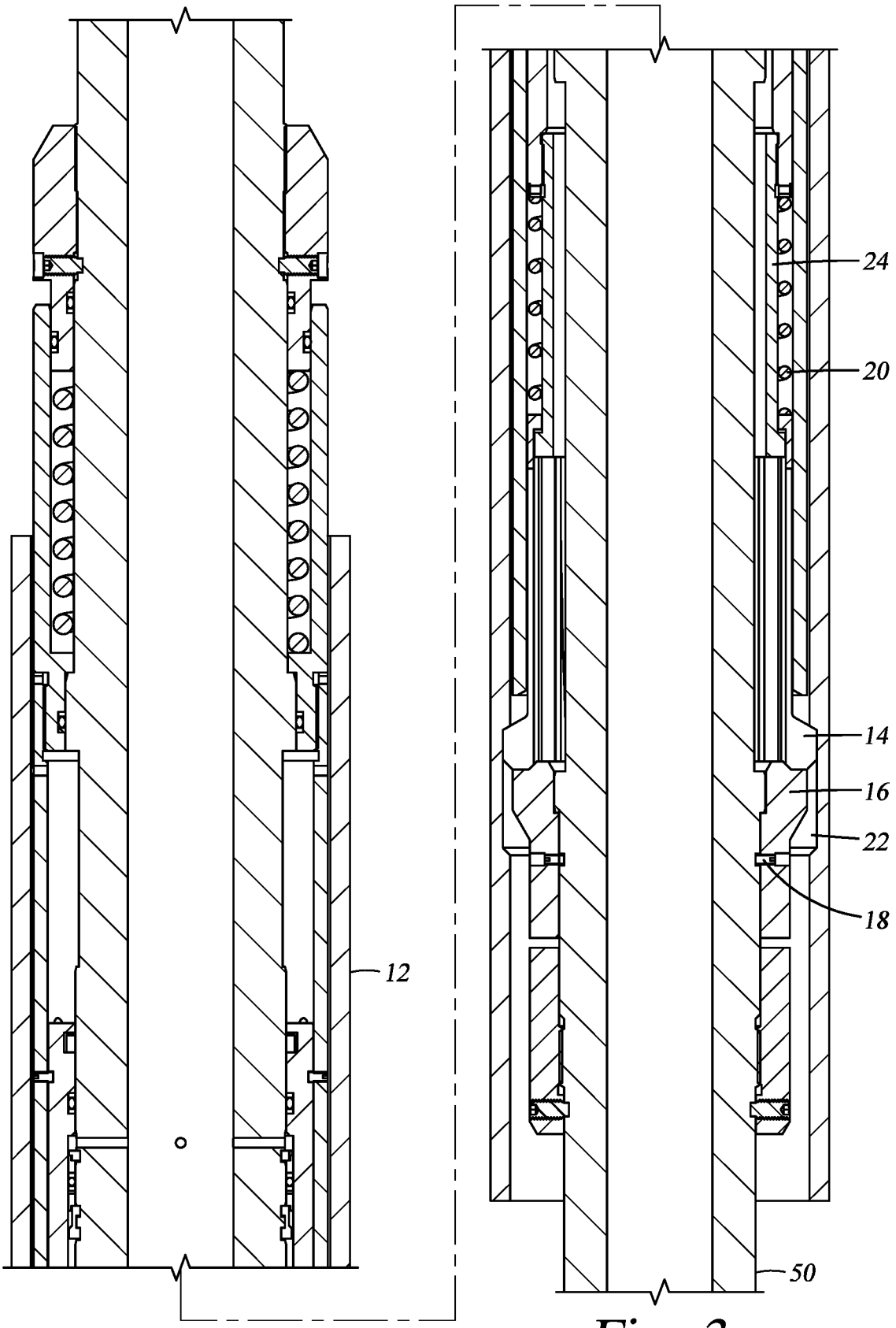
FIG. 3 is a sectional view of a retrieval tool located inside a pup joint and including a carrier that is shown in a latch position.
Figure 4:
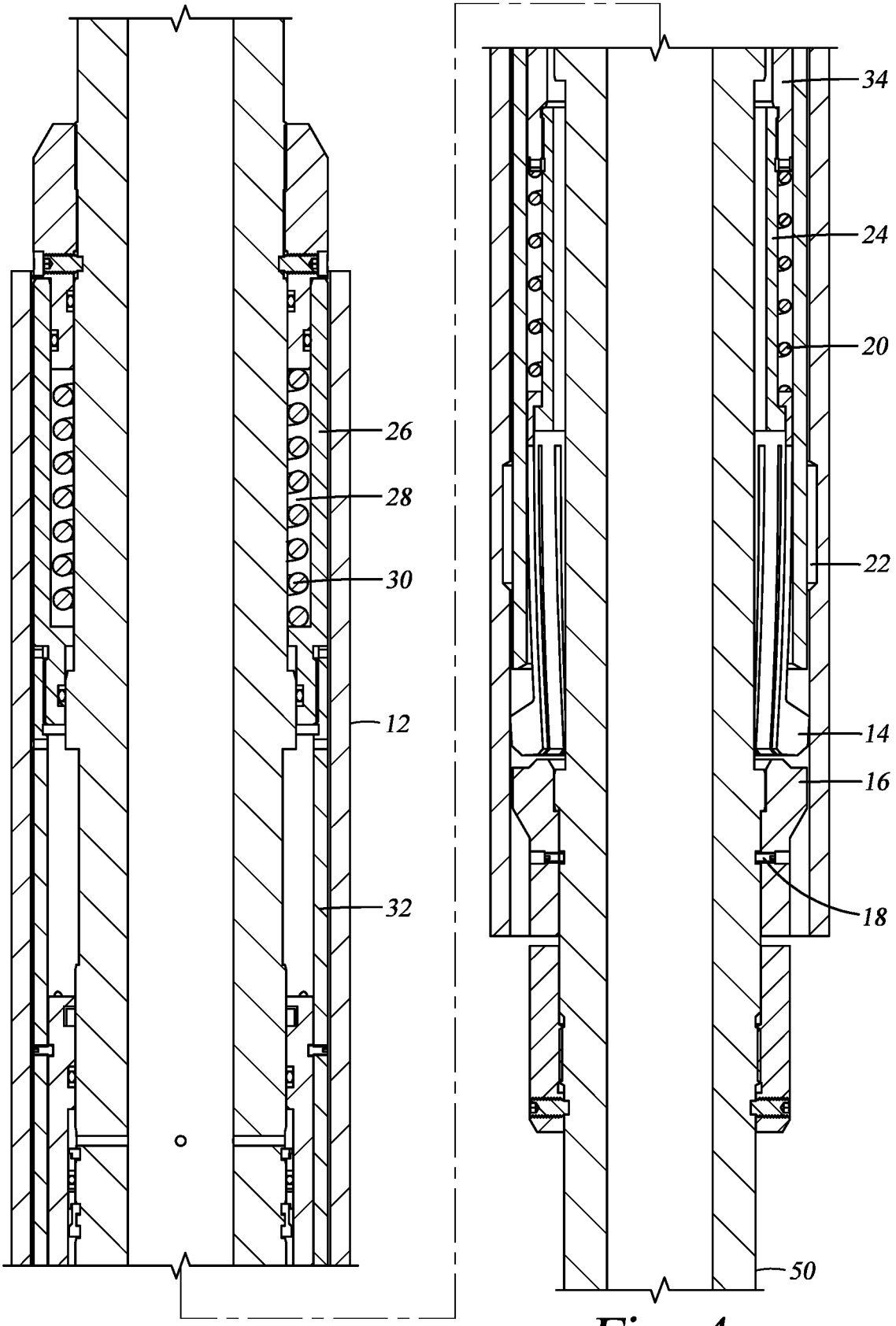
FIG. 4 is a sectional view of a retrieval tool located inside a pup joint and including a carrier that is shown in a release position and a hydrostatic actuator that is shown in a disarmed position.
Figure 5:
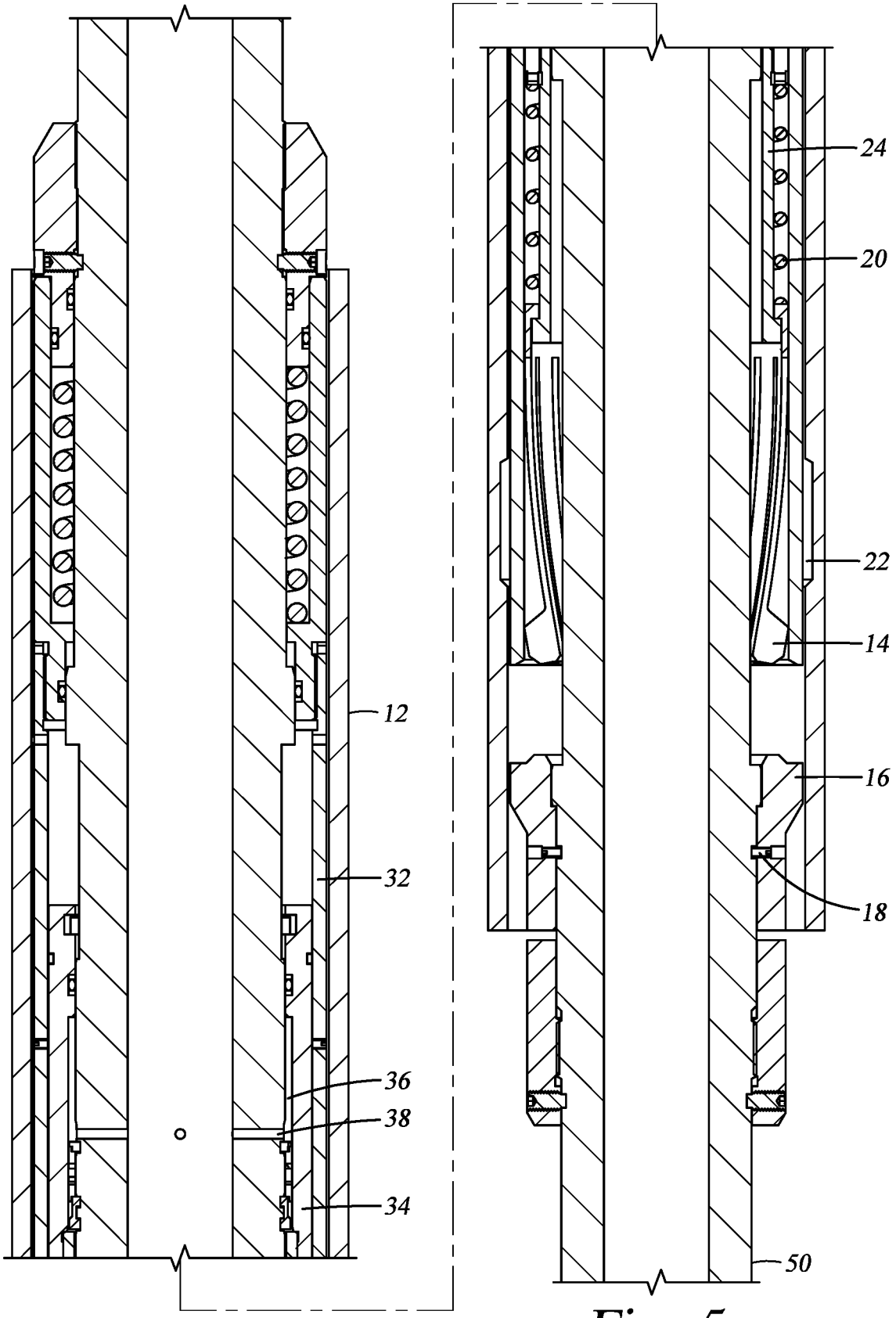
FIG. 5 is a sectional view of a retrieval tool located inside a pup joint and including a carrier that is shown in a release position and a hydraulic actuator that is shown in a disarmed position.
Figure 6:
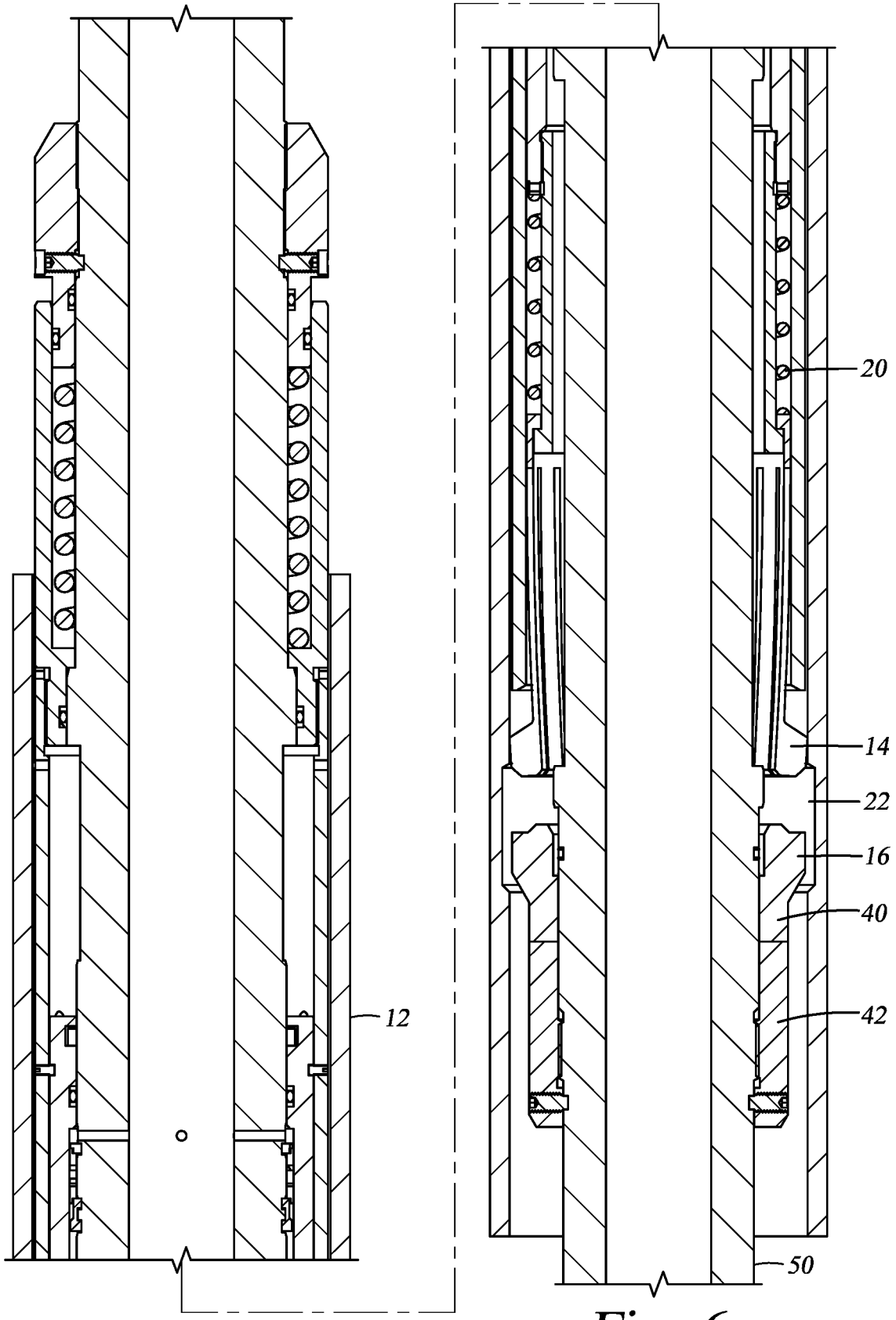
FIG. 6 is a sectional view of a retrieval tool located inside a pup joint and including a carrier that is shown in a release position and a mechanical actuator that is shown in a disarmed position.

FIG. 1 is a perspective view of the retrieval tool 10. FIGS. 2-6 are sectional views of the retrieval tool 10, located inside a pup joint 12, which may be threaded at the top and/or bottom, and forms a portion of, the expandable liner, and illustrate different configurations of the retrieval tool 10. In FIG. 2, the carrier is released, and the three actuators are in their armed positions. The configuration of FIG. 2 is typically utilized when the liner retrieval tool 10 is run-in hole. In FIG. 3, the carrier is latched. The configuration of FIG. 3 is typically utilized to automatically move a severed liner away from the sealing BSR and retrieve it to the surface with no input from the rig. In FIG. 4, the hydrostatic actuator is in its disarmed position, and the carrier is released. The configuration of FIG. 4 is typically utilized when the liner is located below the BoP and, in particular, during expansion operations that occur when the liner is located below the BoP. In FIG. 5, the hydraulic actuator is in its disarmed position, and the carrier is released. The configuration of FIG. 5 is typically utilized during the expansion and setting of the liner when fluid is pumped into the pipe to energize the expansion mechanism and perform the expansion of the liner. In FIG. 6, the mechanical actuator is in its disarmed position, and the carrier is released. The configuration of FIG. 6 is typically utilized for separating the retrieval tool from the expandable liner after the retrieval tool 10 inadvertently latches on the liner during the expansion and setting of the liner.

In the embodiment shown in FIG. 1-6, the carrier of the retrieval tool 10 includes a collet 14, a support ring 16, a shear pin 18, a collet spring 20, and an inner sleeve 24. The support ring 16 is shaped to prevent the fingers of the collet 14 from deflecting radially inwardly when the support ring 16 is located partially below the extremity of the fingers of the collet 14. The support ring 16 is connected to a body 50 of the retrieval tool 10 with the shear pin 18. The collet 14 can slide on the inner sleeve 24. The collet spring 20 urges the collet 14 toward the support ring 16 so that the support ring 16 is located partially below the extremity of the fingers of the collet 14 when the inner sleeve 24 is sufficiently close to support ring 16.

In the embodiment shown in FIGS. 1-6, the collet 14 is initially collapsed within the liner and can be located several feet below a mating latch-in groove 22. The latch-in groove 22 can be machined within the pup joint 12. When the severed pipe is lifted inside the severed liner, the collet 14 latches into the latch-in groove 22, as shown in FIG. 3. The support ring 16 supports the collet 14 and prevents it from deflecting radially inwardly. The contact force between the collet 14 and the pup joint 12 of the expandable liner is sufficiently large for holding the expandable liner on the retrieval tool 10. Thus, the retrieval tool 10 carries the weight of the severed liner.

In the embodiment shown in FIGS. 1-6, the hydrostatic actuator of the retrieval tool 10 includes a piston 26, an air chamber 28, and a spring 30. The air chamber 28 of the hydrostatic actuator has a trapped volume of air at atmospheric pressure. The piston 26 is urged to the bottom side by the spring 30, which applies a selected activation preload. The preload is overcome by an increase in hydrostatic pressure as the retrieval tool 10 is run-in hole. At a predetermined depth below the sub-sea BoP that depends on the selected activation preload, the hydrostatic pressure applied to the piston 26 overcomes the preload of the spring 30, and the piston 26 shifts to the top side as shown in FIG. 4. Thus, the piston 26 pulls, in turn, an outer sleeve 32 and another (passive) piston 34 to the top side, as shown in FIG. 4. The (passive) piston 34 is connected to the inner sleeve 24 of the carrier. Thus, the piston 26 drives the inner sleeve 24 to the top side, causing first the collet spring 20 to expand and then the extremity of the fingers of the collet 14 to separate from the support ring 16. As such, the collet 14 is disarmed. Even if the collet 14 moves into the latch-in groove 22, it is no longer supported by the support ring 16, and it can deflect radially inwardly. Accordingly, the contact force between the collet 14 and the pup joint 12 of the expandable liner is sufficiently small or zero so that the retrieval tool can be separated from the expandable liner.

In the embodiment shown in FIGS. 1-6, the hydraulic actuator of the retrieval tool 10 includes the piston 34, a hydraulic chamber 36, and hydraulic ports 38. The hydraulic actuator utilizes the pressure of the fluid pumped inside the pipe and the retrieval tool 10. The pressure is communicated to the piston 34 through the hydraulic ports 38 that communicate to the inner bore in the retrieval tool 10 and pipe. When fluid is pumped inside the pipe to initiate the expansion and setting of the liner in normal operating procedures, the pressure differential is increased and pushes the piston 34 to the top side, as shown in FIG. 5. The piston 34 is connected to the inner sleeve 24 of the carrier. Thus, the piston 34 pulls, in turn, the collet 14 to the top side under the outer sleeve 32. The outer sleeve 32 hinders the collet 14 from latching into the latch-in groove 22.

In the embodiment shown in FIGS. 1-6, the mechanical actuator of the retrieval tool 10 includes the castellated rings 40 and 42, and the shear pin 18. The mechanical actuator may be activated in the case where the hydrostatic and the hydraulic actuator fail to disarm the collet 14. If the collet 14 latches into latch-in groove 22 during expansion and setting of the liner, and if axial load and/or torsion is applied to the pipe and the retrieval tool 10, the shear pin 18 will shear off. The castellation on the rings 40 and 42 can then align by suitable rotation of the pipe and the retrieval tool 10, and can then intermesh when tension is applied to the pipe and the retrieval tool 10. Thus, the castellated ring 40 slides to the bottom side, as is illustrated in FIG. 6. The castellated ring 40 is connected to the support ring 16. The support ring 16 slides in turn to the bottom side. The collet 14 is no longer supported by the support ring 16, and it can deflect radially inwardly. Accordingly, the contact force between the collet 14 and the pup joint 12 of the expandable liner is sufficiently small or zero so that the retrieval tool can be separated from the expandable liner.

Figure 6A:
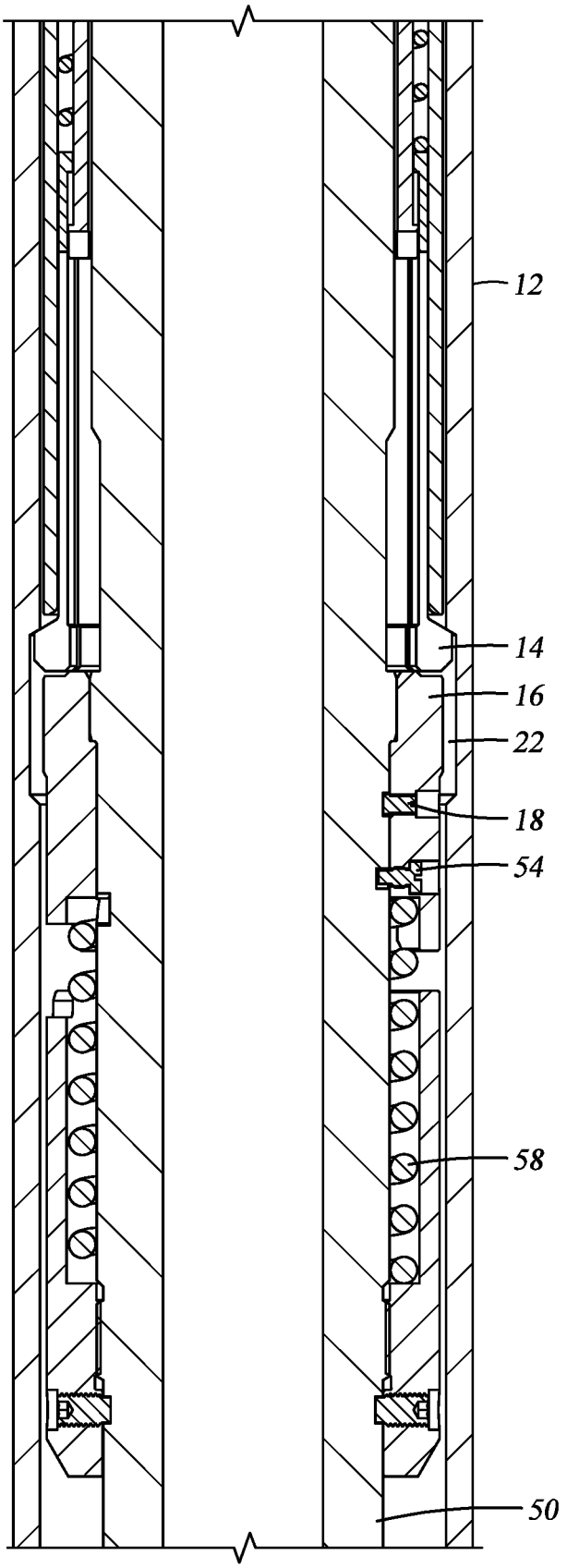
FIGS. 6A and 6B are sectional and perspective views, respectively, of a retrieval tool located inside a pup joint and including a carrier that is shown in a latch position, and a mechanical actuator that is shown in an armed position.
Figure 6B:
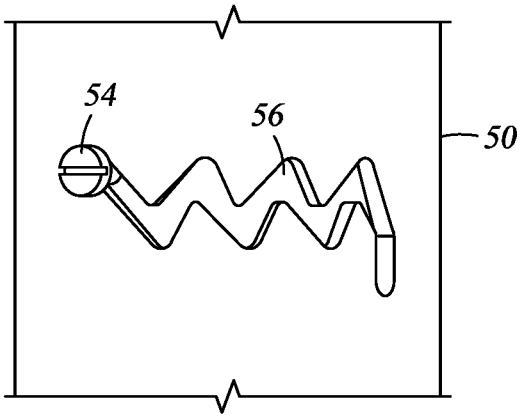
Figure 6C:
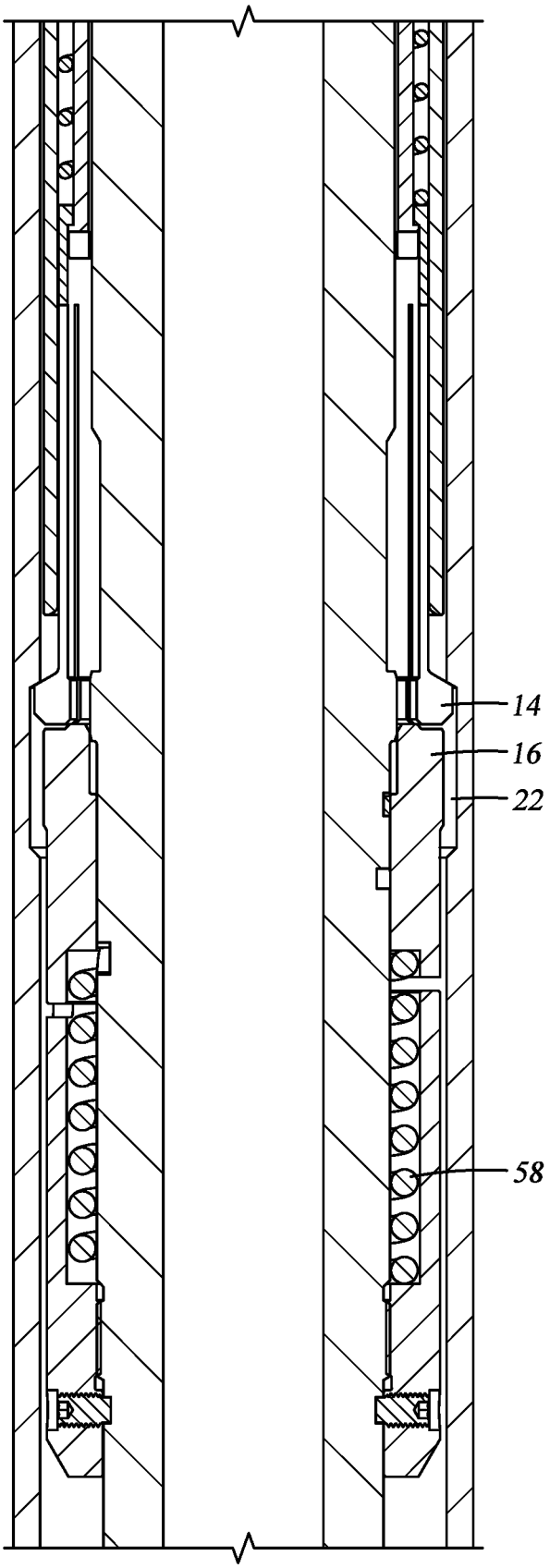
FIGS. 6C and 6D are sectional and perspective views, respectively, of a retrieval tool located inside a pup joint and including a carrier that is shown in a latch position, and a mechanical actuator that is shown in a position intermediate between an armed position and a disarmed position.
Figure 6D:
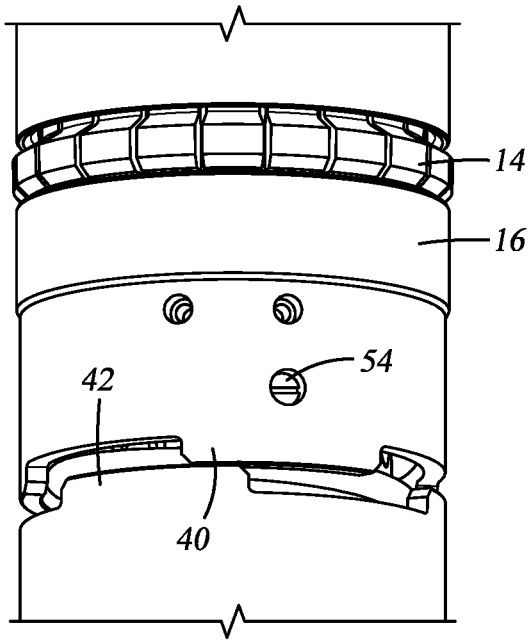
Figure 6F:
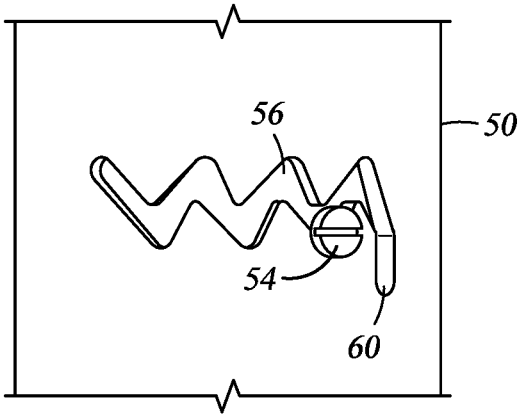
FIGS. 6E and 6F are perspective and sectional views, respectively, of a retrieval tool located inside a pup joint and including a carrier that is shown in a latch position, and a mechanical actuator that is shown in a position intermediate between an armed position and a disarmed position.
Figure 6E:
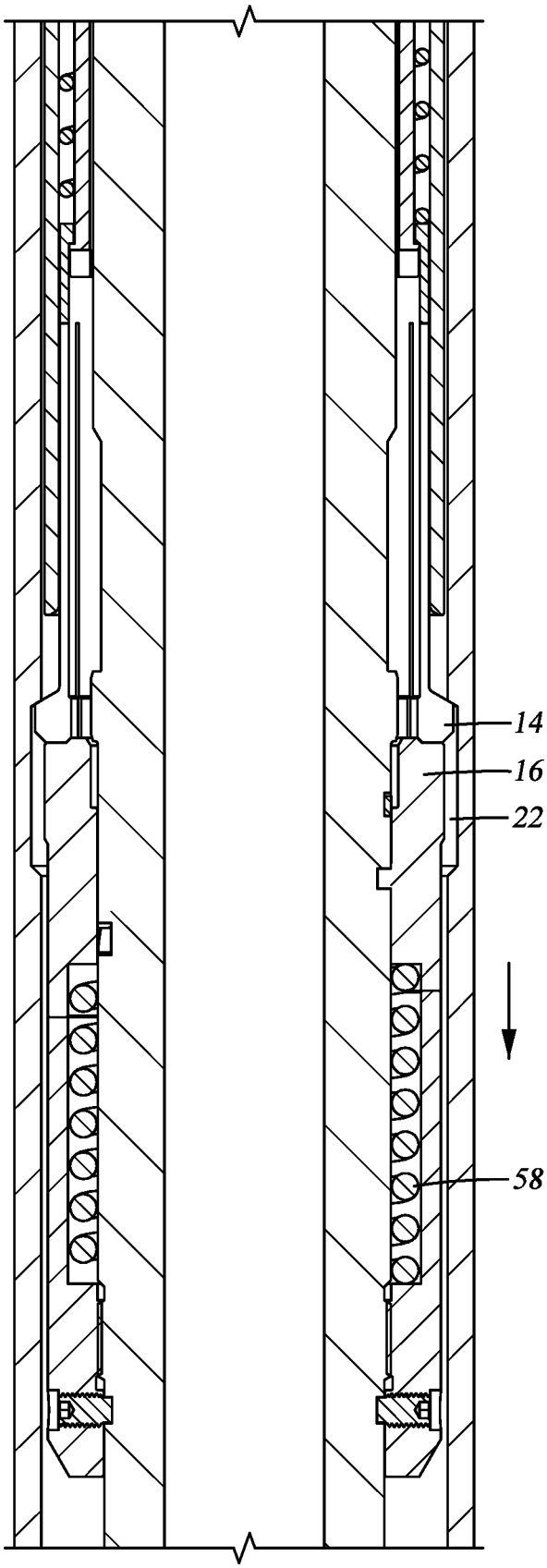

FIGS. 6A-6G illustrate an alternative embodiment of the mechanical actuator shown in FIGS. 1-6. FIGS. 6A, 6C, 6F, and 6H are sectional views of a portion of the retrieval tool 10 illustrating the alternative embodiment of the mechanical actuator. FIGS. 6B and 6E are perspective views of a pin 54 and a profile 56 grooved on the body 50 of the retrieval tool 10, which are part of the alternative embodiment of the mechanical actuator. FIGS. 6D and 6G are perspective views of a portion of the retrieval tool 10 illustrating the alternative embodiment of the mechanical actuator.

Like the mechanical actuator shown in FIGS. 1-6, the mechanical actuator shown in FIGS. 6A-6G also includes the castellated rings 40 and 42, and the shear pin 18. Similar to the mechanical actuator shown in FIGS. 1-6, the mechanical actuator shown in FIGS. 6A-6G may also be activated in the case where the hydrostatic and the hydraulic actuator fail to disarm the collet 14. If the collet 14 latches into latch-in groove 22 during expansion and setting of the liner, as illustrated in FIGS. 6A-6B, and if axial pull and/or torsion is applied to the pipe and the retrieval tool 10, the shear pin 18 will shear off.

However, in the embodiment shown in FIGS. 6A-6G, the support ring 16 includes a pin 54 that engages and is guided by a profile 56 grooved on the body 50 of the retrieval tool 10. The support ring 16 can then rotate relative to the body 50 of the retrieval tool 10 by a suitable series of slacking off and picking up weight of the pipe and the retrieval tool 10. When the weight of the pipe and the retrieval tool 10 is slacked off, a spring 58 extends and pushes the support ring 16 and the pin 54 toward the top. When the weight of the pipe and the retrieval tool 10 is picked up, the collet 14 latches in the latch-in groove 22 and pushes the support ring 16 and the pin 54 toward the bottom, as illustrated in FIGS. 6C-6E. In turn, this movement of the support ring 16 and the pin 54 compresses the spring 58. The series of downward and upward movements of the pin 54 in the profile 56 causes the support ring 16 to rotate. Once the pin 54 has been cycled between downward and upward a preset number of times, the pin 54 will reach an extension 60 of the profile 56, and the castellation on the rings 40 and 42 will align and intermesh when tension is applied to the pipe and the retrieval tool 10. This configuration allows the castellated ring 40 to slide to the bottom side, as is illustrated in FIG. 6G. The castellated ring 40 is connected to the support ring 16. The support ring 16 slides in turn to the bottom side. The collet 14 is no longer supported by the support ring 16, and it can deflect radially inwardly and pass the latch-in groove 22, as illustrated in FIG. 6H. Accordingly, the contact force between the collet 14 and the pup joint 12 of the expandable liner is sufficiently small or zero so that the retrieval tool can be separated from the expandable liner.

In FIGS. 6A and 6B, the carrier is latched, and the actuator is in its armed position. The configuration of FIGS. 6A and 6B would typically occur when the retrieval tool 10 inadvertently latches on the liner during the expansion and setting of the liner. In FIGS. 6C, 6D, 6E, and 6F, the actuator is in successive positions intermediate between its armed position and its unarmed position: the shear pin 18 is sheared off, and the support ring 16 is progressively rotating. The carrier will still latch onto the liner when the weight of the pipe and retrieval tool is picked up while the actuator is in these successive positions. In FIG. 6G, the actuator is in its disarmed position. The configuration of FIG. 6G is typically utilized for separating the retrieval tool from the expandable liner after the retrieval tool 10 inadvertently latches on the liner during the expansion and setting of the liner. In FIG. 6H, the carrier is released.

In other embodiments (not shown) of the mechanical actuator, a similar controlled movement of the support ring 16 for disarming the collet 14 may be achieved by applying torque and counter-torque to the pipe and the retrieval tool 10 by using a profile oriented one quarter turn clockwise relative to the profile 56 shown in FIGS. 6B and 6E.

FIGS. 7-10 show a second embodiment of a retrieval tool 10. In this embodiment, one actuator is provided so that the carrier cannot remain in the latch position. The actuator (also referred to as the hydraulic actuator) relies on hydraulic pressure inside the pipe to move from its armed position to its disarmed position. Additionally, this embodiment may be used to increase the length of expandable liners that may be run-in hole. Currently, a common limiting factor to the length of the liner that can be run-in hole is the liner weight, which may exceed the expansion initiation force when the liner weight is carried in-hole solely on the cone face. However, if the liner weight is being shared between the cone face and the liner retrieval tool 10, as is possible in this embodiment of the retrieval tool 10, longer liners may be deployed without concern of premature expansion initiation.

Figure 7:
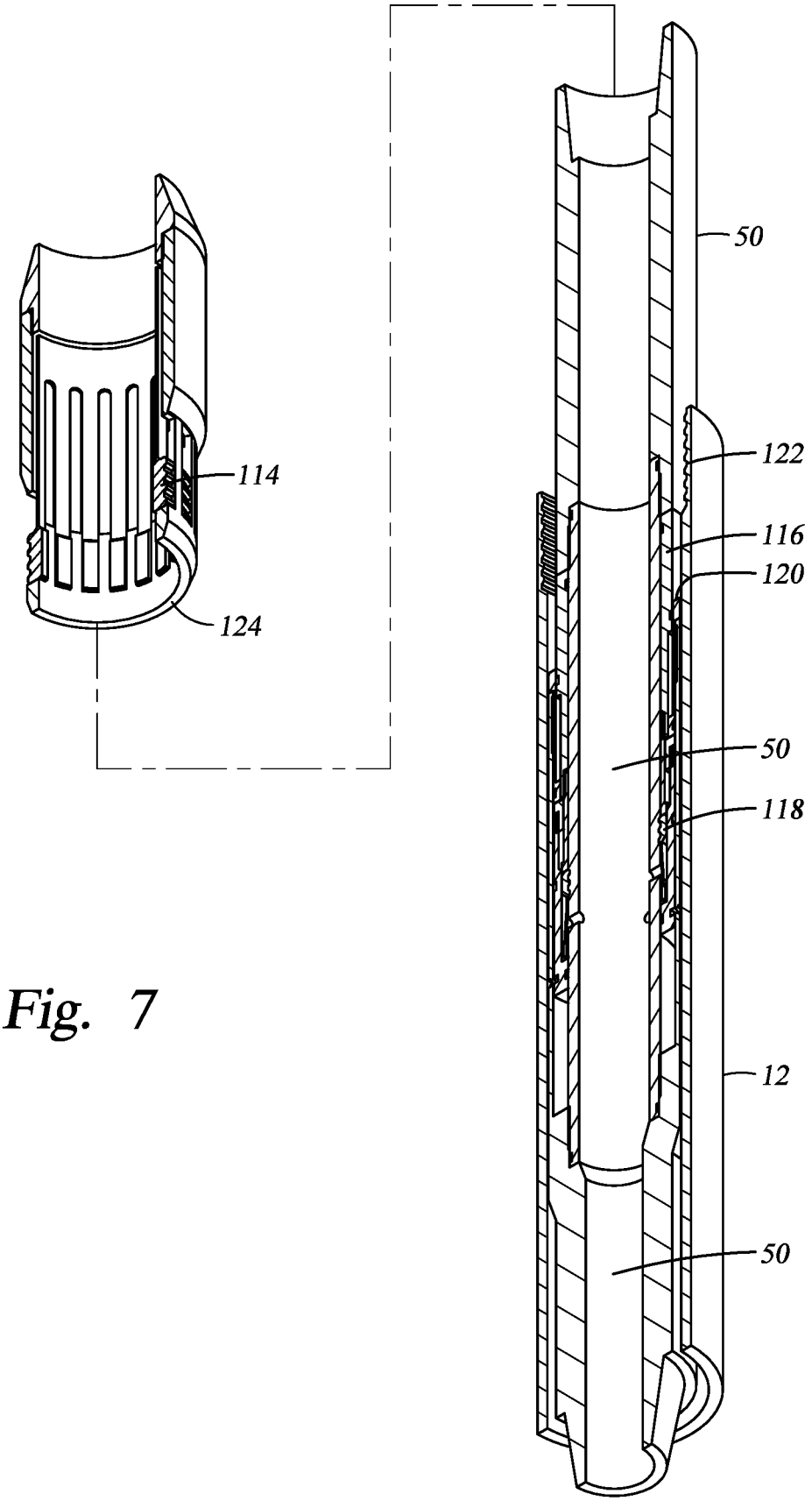
FIG. 7 is a perspective view, partially in cross-section, of a retrieval tool located in a pup joint and including a carrier that is shown in a release position, and a mechanical actuator, wherein the retrieval tool is partially disassembled.
Figure 8:
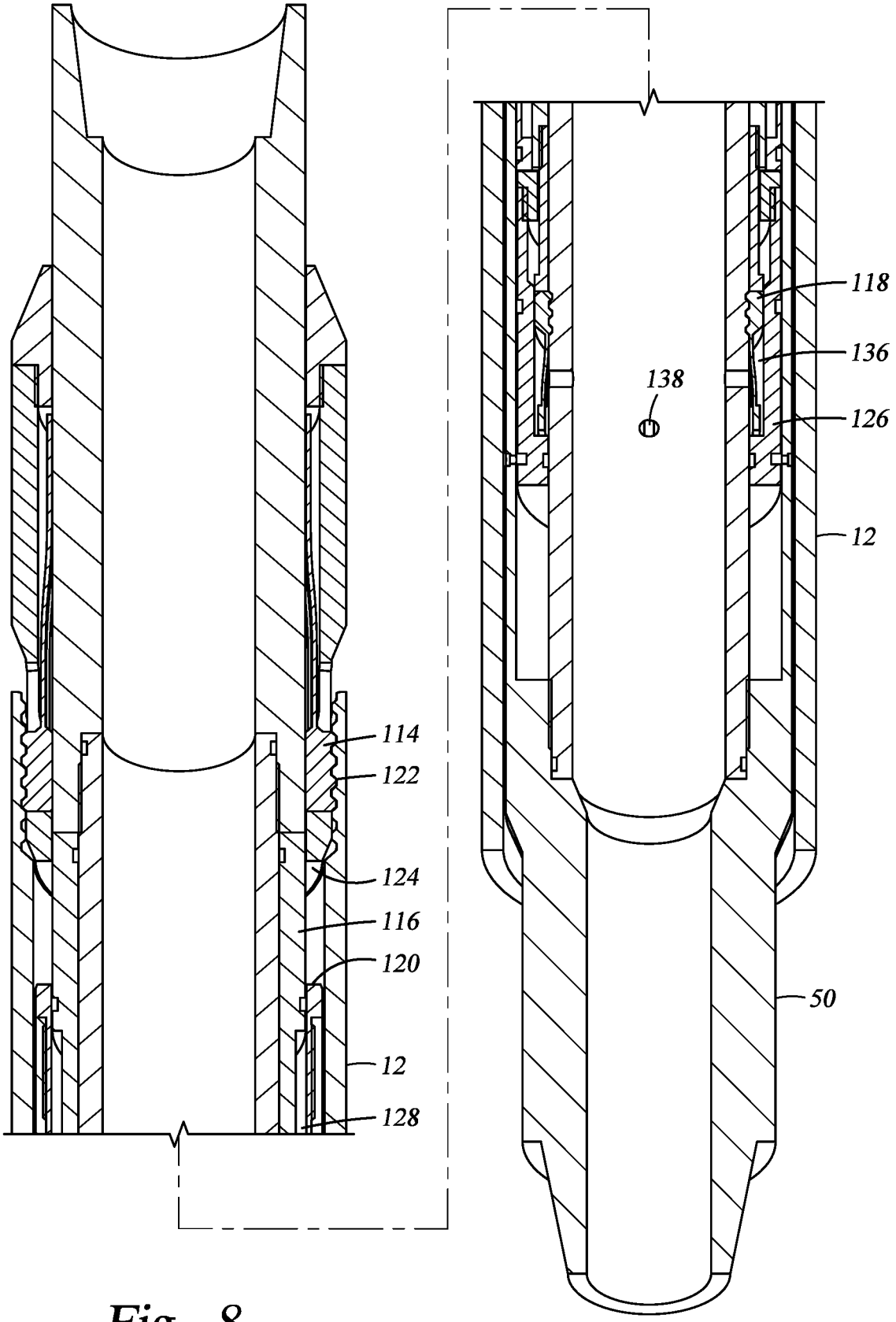
FIG. 8 is a perspective view, partially in cross-section, of a retrieval tool located in a pup joint and including a carrier that is shown in a latch position, and a mechanical actuator that is shown in an armed position.
Figure 9:
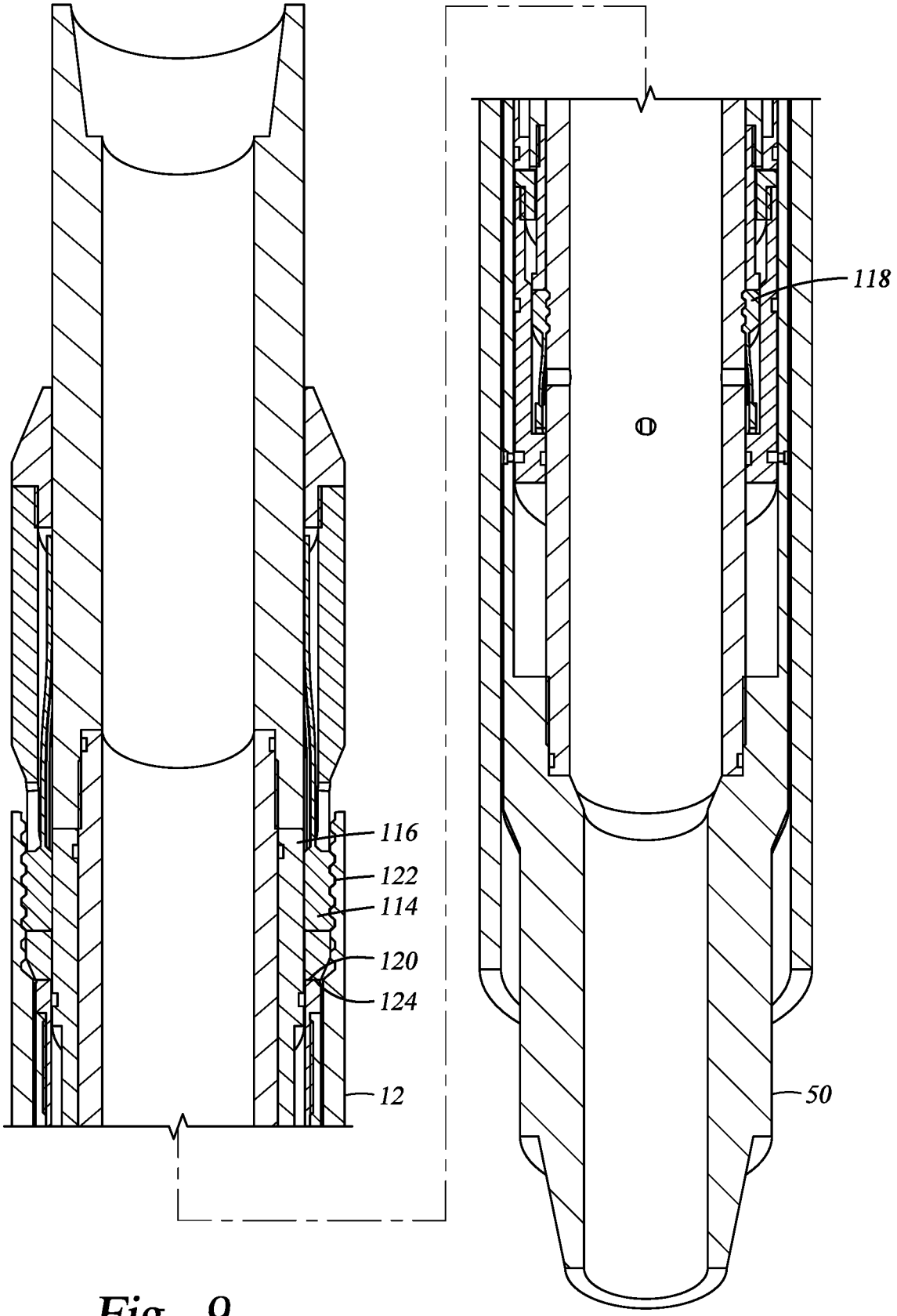
FIG. 9 is a perspective view, partially in cross-section, of a retrieval tool located in a pup joint and including a carrier that is shown in a latch position, and a mechanical actuator that is shown in an armed position.
Figure 10:
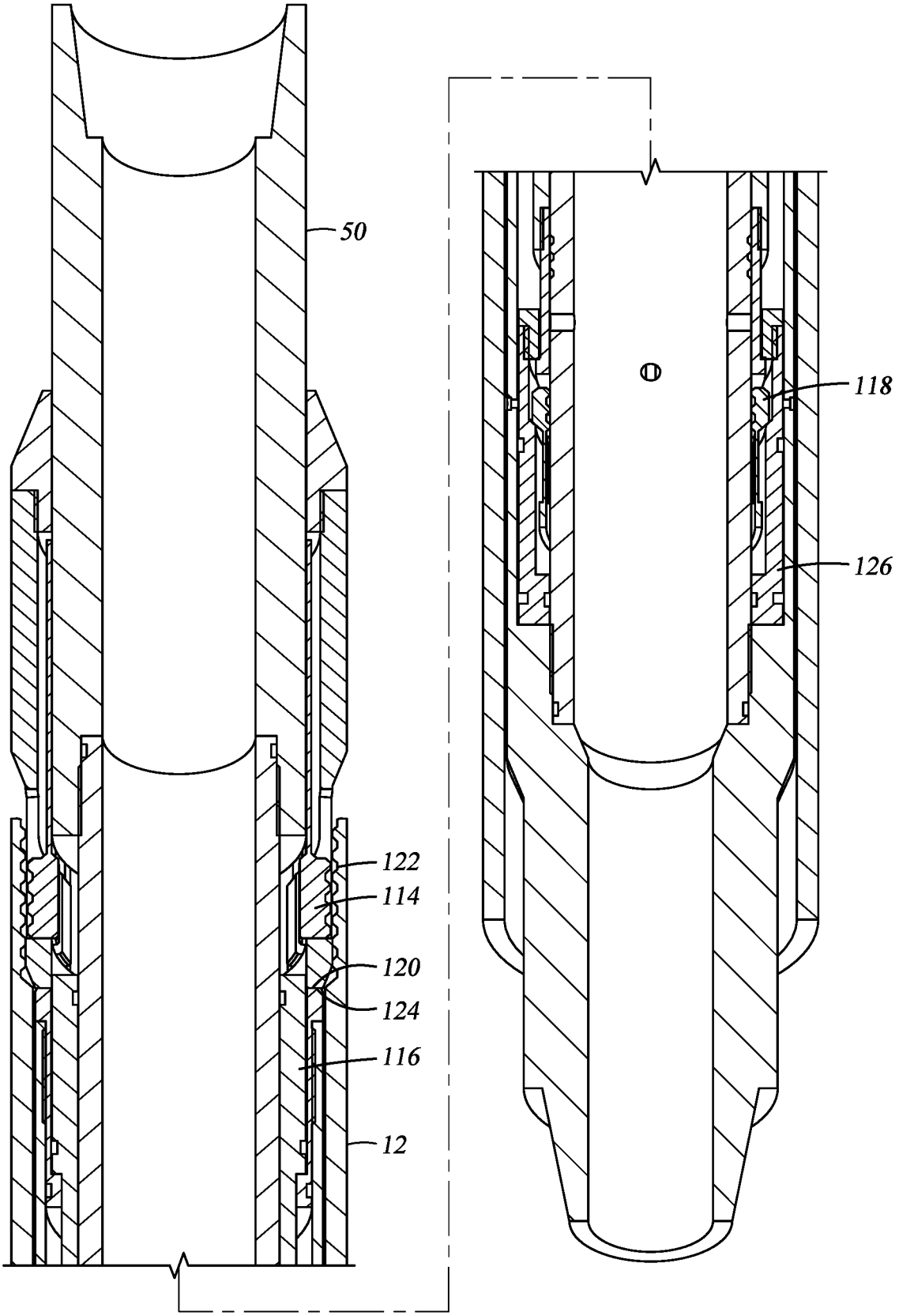
FIG. 10 is a perspective view, partially in cross-section, of a retrieval tool located in a pup joint and including a carrier that is shown in a release position, and a mechanical actuator that is shown in a disarmed position.

FIGS. 7-10 are perspective views of the retrieval tool 10, located inside a pup joint 12, which can be threaded at the top, and forms a portion of, the expandable liner, and illustrate different configurations of the retrieval tool 10. In FIG. 7, the retrieval tool 10 is illustrated before assembly. The configuration of FIG. 7 is typically utilized during rig up. In FIGS. 8-9, the carrier is latched, and the actuator is in its armed position. The configuration of FIG. 8 is typically utilized when the liner retrieval tool 10 is run-in hole. The configuration of FIG. 9 is typically utilized to retrieve a severed liner to surface. The configuration of FIG. 9 can also be utilized when the liner retrieval tool 10 is run-in hole so that the liner weight is being shared by the carrier and the face of the expansion cone. In FIG. 10, the actuator is in its disarmed position, and the carrier is released. The configuration of FIG. 10 is typically utilized during the expansion and setting of the liner.

In the embodiment shown in FIGS. 7-10, the carrier comprises a collet assembly including a collet 114 and a shoulder 124, a tool shoulder 120, a support sleeve 116, and an inner collet 118. The tool shoulder 120 is formed on a part that is connected to the body 50 of the retrieval tool 10. The support sleeve 116 is shaped to prevent the collet 114 from deflecting radially inwardly when the support sleeve 116 is located partially below the collet 114. The support sleeve 116 is connected to the body 50 of the retrieval tool 10 with the inner collet 118. In contrast with the embodiment shown in FIGS. 1-6, wherein the collet 14 is initially collapsed within the liner and can be located several feet below a mating latch-in groove 22, the collet assembly is threaded to the pup joint 12 at the surface to form the run-in hole configuration illustrated in FIG. 8. In this configuration, the shoulder 124 of the collet assembly and the tool shoulder 120 are not in contact; therefore, the liner weight is not transferred to the carrier, and it would only be supported by the face of the expansion cone. In the configuration illustrated in FIG. 9, however, the liner weight is transferred to the carrier. While the collet 114 is under load in this configuration, the collet 114 may nevertheless release, which allows it to play a more active role in carrying the liner weight. Thus, because the liner weight is being shared by the collet 114 and the face of the expansion cone, longer liners may be deployed without concern of premature expansion.

In the embodiment shown in FIGS. 7-10, the actuator of the retrieval tool 10 comprises a piston 126, an air chamber 128, a hydraulic chamber 136, and ports 138. The piston 126 can optionally be held to the body 50 of the retrieval tool 10 with shear pins. When fluid is pumped inside the pipe to initiate the expansion and setting of the liner in normal operating procedures, the pressure differential is increased and urges the piston 126 to the bottom side, as shown in FIG. 10. The piston 126 may move to the bottom side as shown in FIG. 10, when the pressure differential exceeds the shear strength of the shear pins holding the piston 126. When the piston 126 has moved to the bottom side, the inner collet 118 of the carrier is free to move radially outward, allowing the sleeve 116 to also move to the bottom side. In this position, the sleeve 116 allows the collet 114 to deflect radially inwardly. The collet 114 is then free to leave the latched position where the collet 114 engages the latch-in helical grooves 122, as is illustrated in FIGS. 8 and 9. Thus, the contact force between the collet 114 and the expandable liner becomes sufficiently small or zero so that the retrieval tool 10 can be separated from the expandable liner.

Note that in other embodiments (not shown) of the retrieval tool, one or more additional or alternative actuators that rely on hydrostatic pressure around the pipe or on the movement of the pipe and the retrieval tool 10 to move from their armed positions to their disarmed positions, may be provided, while still implementing a carrier similar to the carrier shown in FIGS. 7-10.

FIGS. 11-17 show a third embodiment of a retrieval tool 10. In this embodiment, a set of wicker style slips 214 is utilized to implement the moving portion of the carrier of the retrieval tool 10. The slips 214 ride on the ramps 220 located on a ring 216. The ring 216 is connected to a body 50 of the retrieval tool 10 via rotational travel keys 218*a* and rotational travel slots 218*b*. This embodiment has the advantage of not requiring a specific pup joint with a mating latch-in profile because the slips 214 can engage a severed liner at any point along the liner. The actuator of the retrieval tool 10 is implemented with a piston 226 capable of sliding over piston support 206, hydraulic chamber 236, ports 238, dogs 240, and helical slots 242. The actuator may be cycled between the armed and disarmed positions an unlimited number of times by pumping fluid inside the pipe to increase the pressure inside the pipe and stopping pumping the fluid inside the pipe to decrease the pressure inside the pipe.

Figure 11:
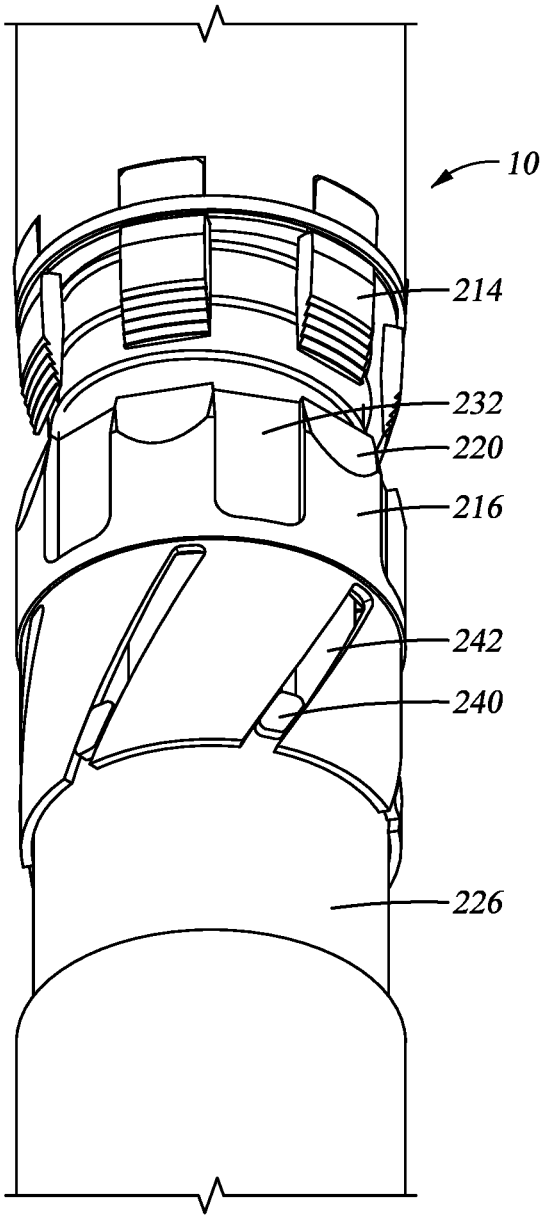
FIG. 11 is a perspective view of a retrieval tool including a carrier and an actuator that is shown in an armed position.
Figure 12:
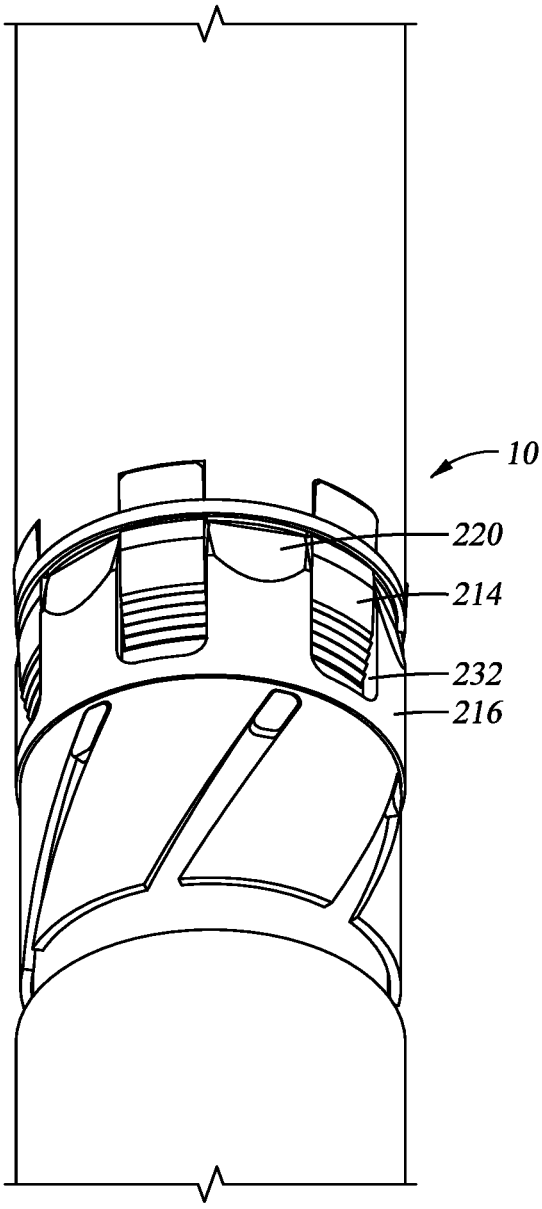
FIG. 12 is a perspective view of a retrieval tool including a carrier and an actuator that is shown in a disarmed position.
Figure 13:
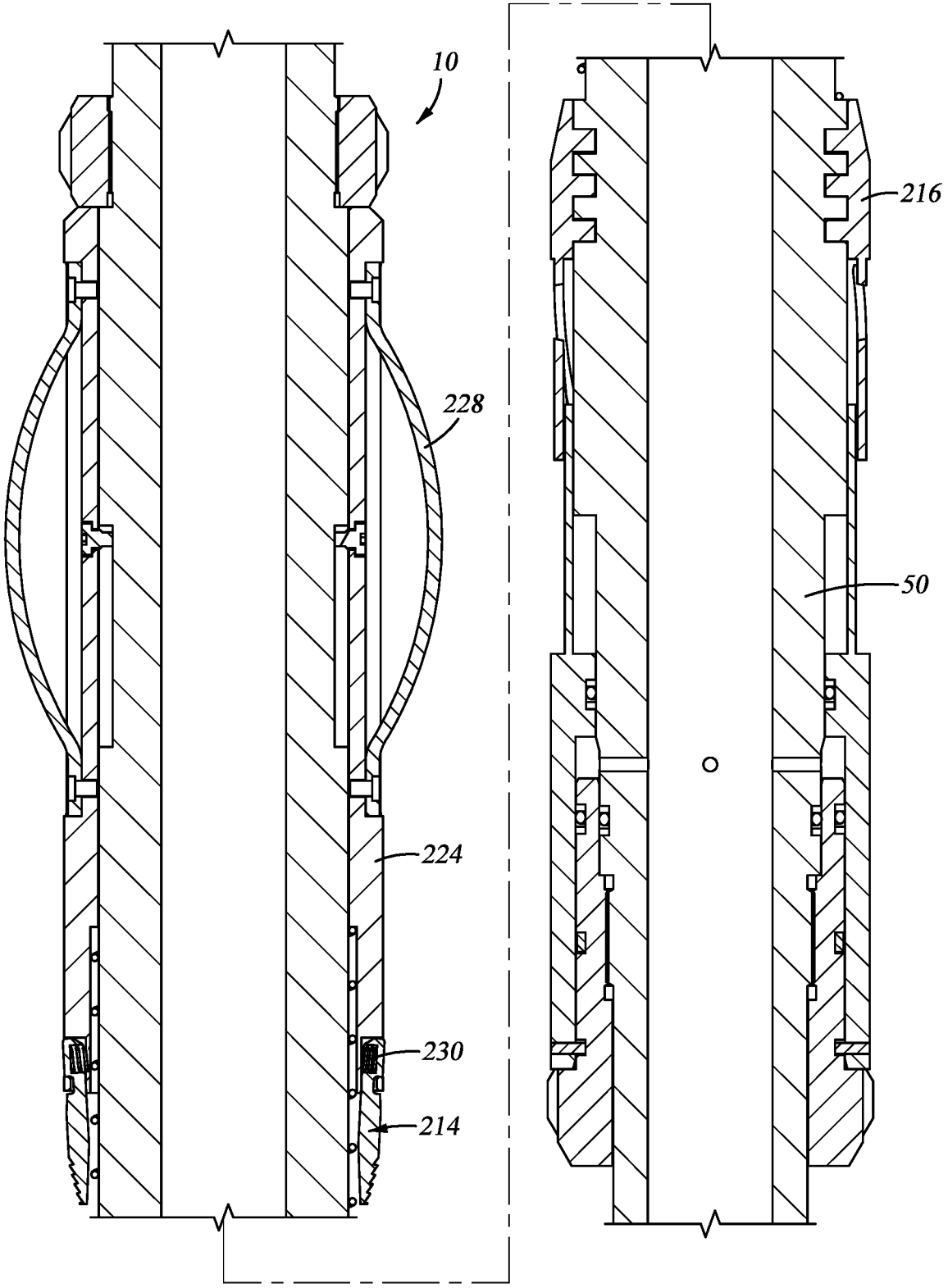
FIG. 13 is a sectional view of a retrieval tool including a carrier that is shown in a release position and an actuator that is shown in an armed position.
Figure 14:
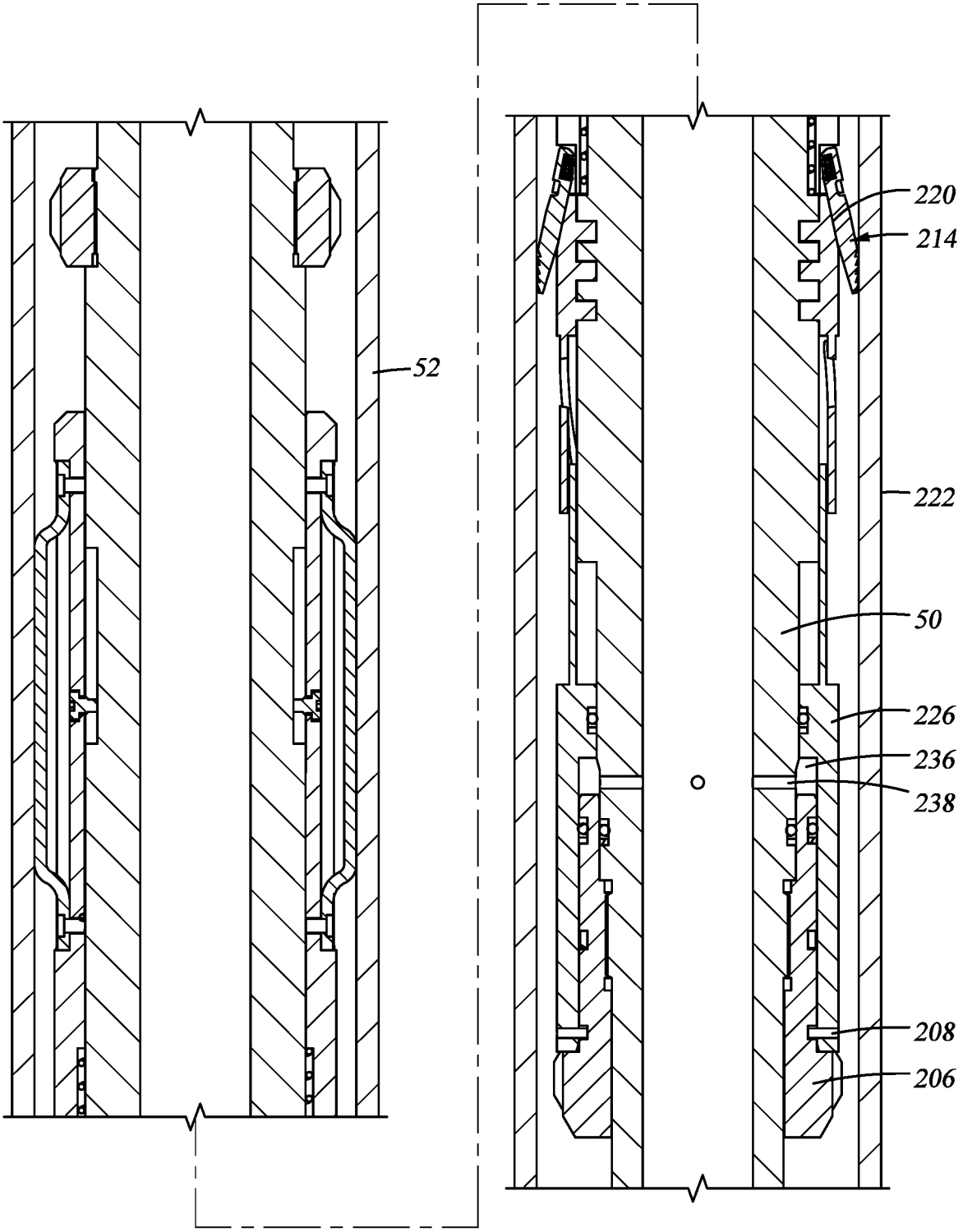
FIG. 14 is a sectional view of a retrieval tool located in a liner and including a carrier that is shown in a latch position and an actuator that is shown in an armed position.
Figure 15:
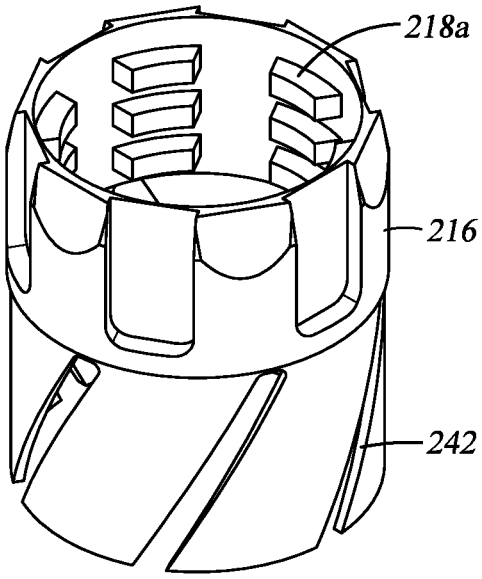
FIGS. 15, 16, and 17 are perspective views of parts of a retrieval tool.
Figure 16:
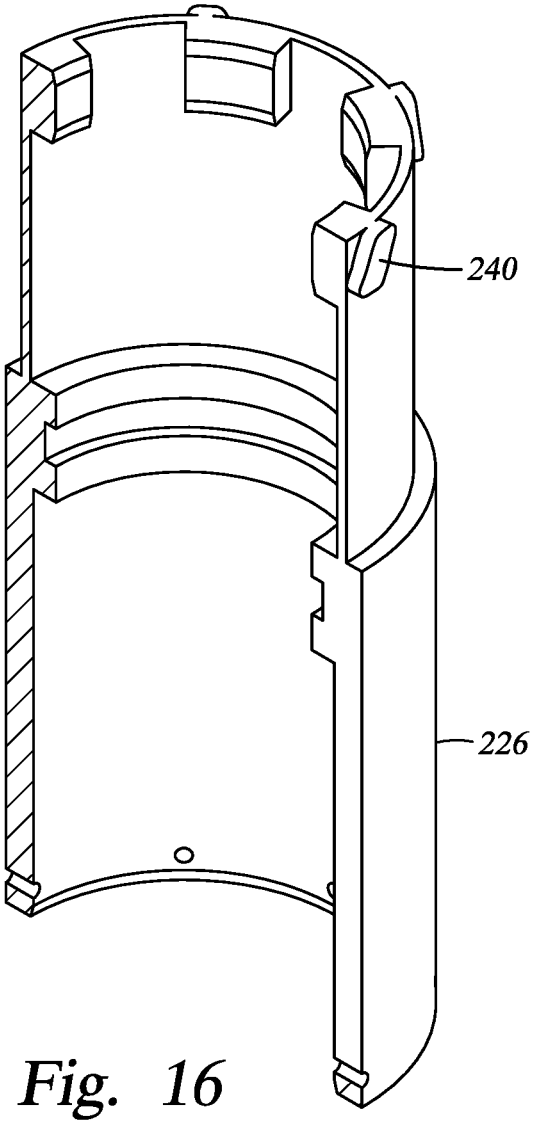
Figure 17:
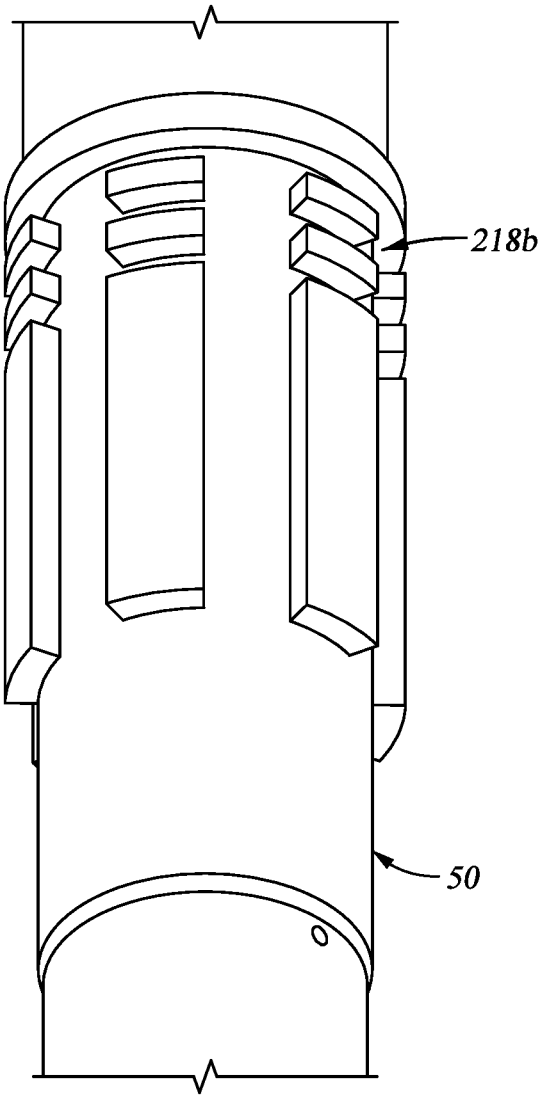

FIGS. 11 and 12 are perspective views of the retrieval tool 10 that illustrate different configurations of the retrieval tool 10. In FIG. 11, the actuator is in its armed position. The configuration of FIG. 11 is typically utilized when the liner retrieval tool 10 is run-in hole. In FIG. 12, the actuator is in its disarmed position. The configuration of FIG. 12 is typically utilized during the expansion and setting of the liner. FIGS. 13 and 14 are sectional views of the retrieval tool 10, located inside a liner 52 shown only in FIG. 14. In FIG. 13, the carrier is released, and the actuator is in its armed position. The configuration of FIG. 13 is typically utilized when the liner retrieval tool 10 is run-in hole. In FIG. 14, the carrier is latched, and the actuator is in its armed position. The configuration of FIG. 14 is typically utilized to automatically move a severed liner away from the sealing BSR and retrieve it to the surface with no input from the rig. FIGS. 15-17 are perspective views of parts of the retrieval tool 10, partially in cross-section.

In the embodiment shown in FIGS. 11-17, the carrier of the retrieval tool 10 further comprises a coil spring 230, a sleeve 224, and bow springs 228. In use, the bow springs 228 are compressed in the liner 52. In the run-in hole configuration, the bow springs 228, and the coil spring 230 keeps the slips 214 from engaging the ring 216. If the BoP is activated, thus severing the pipe and the liner 52, the liner retrieval tool 10 can move to the top side, as shown in FIG. 14, while the bow springs 228 hold the sleeve 224 and the slips 214 in place relative to the liner 52. Thus, the slips 214 will ride on the ramps 220 of the ring 216 and engage the liner 52. As such, the severed liner 52 can be pulled out of the hole.

In the embodiment shown in FIGS. 11-17, the actuator of the retrieval tool 10 unlocks through the use of differential pressure that arises when fluid is pumped inside the pipe to initiate the expansion and setting of the liner in normal operating procedures. When the pressure differential is increased, shearing optional shear pins 208 and overcoming the compression of the coil spring 230, the piston 226 is urged toward the top, as illustrated in FIG. 12. The displacement of the piston 226 in the axial direction causes the dogs 240 to travel within the helical slots 242 and rotates the ring 216. When the ring 216 is rotated as shown in FIG. 12, the slips 214 align with the slots 232 formed in the ring 216. The slots 232 are shaped so that the slips 214 are not urged radially outward when they intermesh with the slots 232. In contrast, when the pressure differential is decreased, the piston 226 is urged toward the bottom, as illustrated in FIG. 11 by the coil spring 230. The ring 216 returns to its original orientation, as shown in FIG. 11. When the ring 216 is in its original orientation, the slips 214 align with the ramps 220 formed in the ring 216. When the slips 214 ride on the ramps 220 of the ring 216, the slips 214 are urged radially outward, as shown in FIG. 14, and engage the liner 52.

Note that in other embodiments (not shown) of the retrieval tool 10, one or more additional or alternative actuators that rely on hydrostatic pressure around the pipe or on the movement of the pipe and the retrieval tool 10 to move from their armed positions to their disarmed positions, may be provided, while still implementing a carrier similar to the carrier shown in FIGS. 11-17.

In yet another embodiment (not shown), the retrieval tool may utilize an inflatable packer positioned around, and connected to, the body of the retrieval tool in order to deploy an expandable liner. This packer is filled with air or another compressible medium. In this embodiment, the carrier of the retrieval tool is implemented with the layer of the packer, and the actuator of the retrieval tool is implemented with the compressible medium. The end portions of the packer are connected to the body of the retrieval tool, and the central portion of the packer is movable between a latch position, wherein a contact force between the central portion of the packer and the expandable liner is sufficiently large for holding the expandable liner on the retrieval tool, and a release position, wherein the contact force between the central portion of the packer and the expandable liner is sufficiently small or zero so that the retrieval tool can be separated from the expandable liner. The packer is inflated to the desired pressure and pressed against the inner diameter of the liner. The pressure can be selected such that the friction force of the packer layer against the liner is capable of holding the severed portion of the liner on the retrieval tool, and retrieve the severed portion of the liner in the case where the BoP is activated. However, once the liner is run sufficiently below the BoP, hydrostatic pressure compresses the packer, preventing it from contacting the inner diameter of the liner. At these depths below the BoP level, the retrieval tool may not be able to pick up the liner, and thus, will not interfere with normal liner expansion operations.

In all the embodiments of the retrieval tool 10 disclosed hereinabove, the carrier is described as having a first portion that is connected to the body of the retrieval tool, and a second portion that is movable between a latch position, wherein a contact force between the second portion and the expandable liner is sufficiently large for holding the expandable liner on the retrieval tool, and a release position, wherein the contact force between the second portion and the expandable liner is sufficiently small or zero so that the retrieval tool can be separated from the expandable liner. Alternatively, the role of the retrieval tool 10 and the expandable liner can be switched. For example, a toroidal packer filled with a compressible medium may be provided inside, and be connected to, a pup joint forming the expandable liner. The packer may selectively contact a retrieval tool passing inside the packer. As such, the carrier may have a first portion that is connected to the expandable liner, and a second portion that is movable between a latch position, wherein a contact force between the second portion and the body of the retrieval tool is sufficiently large for holding the expandable liner on the retrieval tool, and a release position, wherein the contact force between the second portion and the body of the retrieval tool is sufficiently small or zero so that the retrieval tool can be separated from the expandable liner.

In use, the expandable liner is usually expanded. As such, a method of deploying an expandable liner in a well in accordance with an aspect of the disclosure comprises the steps of providing a string including a pipe and a retrieval tool as disclosed herein, lowering the string from a rig through a Blow-out Preventer into the well while the actuator is in the armed position, shifting the actuator into the disarmed position after the expandable liner has passed the Blow-out Preventer and the expandable liner is located below the Blow-out Preventer, and expanding at least a portion of the expandable liner with the expansion cone while the actuator is in the disarmed position. Optionally, the actuator of the retrieval tool may be a backup actuator, and the method may further comprise the step of detecting that a primary actuator of the retrieval tool is not in the disarmed position and/or the carrier of the retrieval tool is inadvertently in the latch position. The backup actuator may be adapted to shift into the disarmed position by translating and/or rotating the pipe.

In some cases, the expandable liner may be retrieved from the well before it has been expanded. As such, a method of deploying an expandable liner in a well in accordance with another aspect of the disclosure comprises the steps of providing a string including a pipe and a retrieval tool as disclosed herein, lowering the string from a rig through a Blow-out Preventer into the well while the actuator is in the armed position, shifting the actuator into the disarmed position after the expandable liner has passed the Blow-out Preventer and the expandable liner is located below the Blow-out Preventer, shifting the actuator back into the armed position before the expandable liner passes through the Blow-out Preventer again and the expandable liner is still located below the Blow-out Preventer, and pulling the string including the expandable liner out of the well through the Blow-out Preventer while the actuator is in the armed position.

In yet other cases, the BoP may function when the pipe and the expandable liner are in the BoP. As such, a method of deploying an expandable liner in a well in accordance with another aspect of the disclosure comprises the steps of providing a string including a pipe and a retrieval tool as disclosed herein, lowering the string from a rig through a Blow-out Preventer into the well while the actuator is in the armed position, severing the pipe and the expandable liner with the shear rams of the Blow-out Preventer, pulling the top portion of the pipe and the expandable liner out of the Blow-out Preventer while the actuator is in the armed position; and sealing the Blow-out Preventer above the bottom portion of the pipe and the expandable liner.

The claimed invention is susceptible to various modifications and alternative forms, and specific embodiments thereof are shown by way of example in the drawings and description. It should be understood, however, that the drawings and detailed description thereto are not intended to limit the claims to the particular form disclosed, but on the contrary, the intention is to cover all modifications, equivalents, and alternatives falling within the scope of the claims.

What is claimed is:

1. A method of deploying an expandable liner in a well, the method comprising:

providing a string including:

a pipe, the pipe being connected to an expansion mechanism, the expansion mechanism including an expansion cone, the expansion cone supporting the expandable liner around the pipe;

a retrieval tool having a body that is connected to the pipe, a connection of the body to the pipe being located above the expansion mechanism, the retrieval tool including:

a carrier having a first portion connected to one of the body of the retrieval tool or the expandable liner, the carrier having a second portion that is movable between a latch position, wherein a contact force between the second portion and the other of the body of the retrieval tool or the expandable liner is sufficiently large for holding the expandable liner on the retrieval tool, and a release position, wherein the contact force between the second portion and the other of the body of the retrieval tool or the expandable liner is sufficiently small or zero so that the retrieval tool can be separated from the expandable liner, and an actuator located proximate to the second portion of the carrier that is movable, the actuator having an armed position, wherein the actuator allows or causes the second portion to move into the latch position and hinders the second portion from leaving the latch position, and a disarmed position, wherein the actuator hinders the second portion from moving into the latch position or allows the second portion to leave the latch position, wherein the actuator is adapted to shift into the disarmed position by hydrostatic pressure outside the pipe that is higher than a pre-determined threshold, the pre-determined threshold being larger than hydrostatic pressure at the Blow-out Preventer;

lowering the string including the expandable liner from a rig through a Blow-out Preventer into the well while the actuator is in the armed position;

shifting the actuator into the disarmed position after the expandable liner has passed the Blow-out Preventer and the expandable liner is located below the Blow-out Preventer; and expanding at least a portion of the expandable liner with the expansion cone while the actuator is in the disarmed position.

2. The method of claim 1, wherein the actuator is a second actuator, the retrieval tool further comprising a first actuator located proximate to the second portion of the carrier that is movable, the first actuator having an armed position wherein the second portion is capable of moving into and remain in the latch position, and a disarmed position wherein the second portion cannot move into or cannot remain in the latch position.

3. The method of claim 2, wherein the first actuator is adapted to shift into the disarmed position when the pressure differential between inside the pipe and outside the pipe exceeds a pre-determined threshold, the method further comprising pumping fluid inside the pipe to increase the pressure inside the pipe.

4. The method of claim 2, wherein the first actuator is adapted to shift into the disarmed position when the second portion of the carrier that is movable is in the latch position and a load applied to the pipe is cycled a pre-determined number of times, the method further comprising cycling the load applied to the pipe after detecting that the second portion of the carrier that is movable is in the latch position.

5. The method of claim 1, wherein the carrier includes a collet and a support ring, and wherein the actuator includes a piston, an air chamber, and a spring, whereby the hydrostatic pressure higher than the pre-determined threshold shifts the piston to cause the collet to separate from the support ring.

6. A method of deploying an expandable liner in a well, the method comprising:

providing a string including:

a pipe, the pipe being connected to an expansion mechanism, the expansion mechanism including an expansion cone, the expansion cone supporting the expandable liner around the pipe a retrieval tool having a body that is connected to the pipe, a connection of the body to the pipe being located above the expansion mechanism, the retrieval tool including:

a carrier having a first portion connected to one of the body of the retrieval tool or the expandable liner, the carrier having a second portion that is movable between a latch position, wherein a contact force between the second portion and the other of the body of the retrieval tool or the expandable liner is sufficiently large for holding the expandable liner on the retrieval tool, and a release position wherein the contact force between the second portion and the other of the body of the retrieval tool or the expandable liner is sufficiently small or zero such that the retrieval tool can be separated from the expandable liner, and an actuator located proximate to the second portion of the carrier that is movable, the actuator having an armed position, wherein the actuator allows or causes the second portion to move into the latch position and hinders the second portion from leaving the latch position, and a disarmed position, wherein the actuator hinders the second portion from moving into the latch position or allows the second portion to leave the latch position, wherein the actuator is adapted to shift into the disarmed position by hydrostatic pressure outside the pipe that is higher than a first pre-determined threshold, and wherein the actuator is adapted to shift into the armed position by hydrostatic pressure outside the pipe that is lower than a second pre-determined threshold, the first pre-determined threshold and the second pre-determined threshold being larger than hydrostatic pressure at the Blow-out Preventer;

lowering the string including the expandable liner from a rig through a Blow-out Preventer into the well while the actuator is in the armed position;

shifting the actuator into the disarmed position after the expandable liner has passed through the Blow-out Preventer and the expandable liner is located below the Blow-out Preventer;

shifting the actuator into the armed position before the expandable liner passes through the Blow-out Preventer again and the expandable liner is still located below the Blow-out Preventer; and pulling the string including the expandable liner out of the well through the Blow-out Preventer while the actuator is in the armed position.

7. The method of claim 6, wherein the first pre-determined threshold is equal to or larger than the second pre-determined threshold.

8. A method of deploying an expandable liner in a well, the method comprising:

providing a string including:

a pipe, the pipe being connected to an expansion mechanism, the expansion mechanism including an expansion cone, the expansion cone supporting the expandable liner around the pipe a retrieval tool having a body that is connected to the pipe, a connection of the body to the pipe being located above the expansion mechanism, the retrieval tool including:

a carrier having a first portion connected to one of the body of the retrieval tool or the expandable liner, the carrier having a second portion that is movable between a latch position, wherein a contact force between the second portion and the other of the body of the retrieval tool or the expandable liner is sufficiently large for holding the expandable liner on the retrieval tool, and a release position wherein the contact force between the second portion and the other of the body of the retrieval tool or the expandable liner is sufficiently small or zero such that the retrieval tool can be separated from the expandable liner, and an actuator located proximate to the second portion of the carrier that is movable, the actuator having an armed position, wherein the actuator allows or causes the second portion to move into the latch position and hinders the second portion from leaving the latch position, and a disarmed position, wherein the actuator hinders the second portion from moving into the latch position or allows the second portion to leave the latch position;

lowering the string including the expandable liner from a rig through a Blow-out Preventer into the well while the actuator is in the armed position, wherein the carrier is in the release position while the string including the expandable liner is lowered from the rig;

moving the second portion of the carrier that is movable into the latch position;

severing the pipe and the expandable liner with the shear rams of the Blow-out Preventer, the pipe and the expandable liner being severed into a top portion and a bottom portion, the retrieval tool being included in the top portion;

pulling the top portion of the pipe and the expandable liner out of the Blow-out Preventer while the actuator is in the armed position; and sealing the Blow-out Preventer above the bottom portion of the pipe and the expandable liner.

9. A method of deploying an expandable liner in a well, the method comprising:

providing a string including:

a pipe, the pipe being connected to an expansion mechanism, the expansion mechanism including an expansion cone, the expansion cone supporting the expandable liner around the pipe;

a retrieval tool having a body that is connected to the pipe, a connection of the body to the pipe being located above the expansion mechanism, the retrieval tool including:

a carrier having a first portion connected to one of the body of the retrieval tool or the expandable liner, the carrier having a second portion that is movable between a latch position, wherein a contact force between the second portion and the other of the body of the retrieval tool or the expandable liner is sufficiently large for holding the expandable liner on the retrieval tool, and a release position, wherein the contact force between the second portion and the other of the body of the retrieval tool or the expandable liner is sufficiently small or zero so that the retrieval tool can be separated from the expandable liner, a first actuator located proximate to the second portion of the carrier that is movable, the first actuator having an armed position wherein the second portion is capable of moving into and remain in the latch position, and a disarmed position wherein the second portion cannot move into or cannot remain in the latch position, and a second actuator located proximate to the second portion of the carrier that is movable, the second actuator having an armed position, wherein the second actuator allows or causes the second portion to move into the latch position and hinders the second portion from leaving the latch position, and a disarmed position, wherein the second actuator hinders the second portion from moving into the latch position or allows the second portion to leave the latch position, wherein the second actuator is adapted to shift into the disarmed position when the second portion of the carrier that is movable is in the latch position and a load applied to the pipe is cycled a pre-determined number of times;

lowering the string including the expandable liner from a rig through a Blow-out Preventer into the well while the second actuator is in the armed position;

detecting that the first actuator is not in the disarmed position;

cycling the load applied to the pipe after detecting that the second portion of the carrier that is movable is in the latch position;

shifting the second actuator into the disarmed position after the expandable liner has passed the Blow-out Preventer and the expandable liner is located below the Blow-out Preventer; and expanding at least a portion of the expandable liner with the expansion cone while the second actuator is in the disarmed position.

10. The method of claim 9, wherein the first actuator is adapted to shift into the disarmed position when the pressure differential between inside the pipe and outside the pipe exceeds a pre-determined threshold, the method further comprising pumping fluid inside the pipe to increase the pressure inside the pipe.

11. A method of deploying an expandable liner in a well, the method comprising:

providing a string including:

a pipe, the pipe being connected to an expansion mechanism, the expansion mechanism including an expansion cone, the expansion cone supporting the expandable liner around the pipe;

a retrieval tool having a body that is connected to the pipe, a connection of the body to the pipe being located above the expansion mechanism, the retrieval tool including:

a carrier having a first portion connected to one of the body of the retrieval tool or the expandable liner, the carrier having a second portion that is movable between a latch position, wherein a contact force between the second portion and the other of the body of the retrieval tool or the expandable liner is sufficiently large for holding the expandable liner on the retrieval tool, and a release position, wherein the contact force between the second portion and the other of the body of the retrieval tool or the expandable liner is sufficiently small or zero so that the retrieval tool can be separated from the expandable liner, and an actuator located proximate to the second portion of the carrier that is movable, the actuator having an armed position, wherein the actuator allows or causes the second portion to move into the latch position and hinders the second portion from leaving the latch position, and a disarmed position, wherein the actuator hinders the second portion from moving into the latch position or allows the second portion to leave the latch position, wherein the actuator is adapted to shift into the disarmed position when a load applied to the pipe is cycled a pre-determined number of times;

lowering the string including the expandable liner from a rig through a Blow-out Preventer into the well while the actuator is in the armed position;

shifting the actuator into the disarmed position after the expandable liner has passed the Blow-out Preventer and the expandable liner is located below the Blow-out Preventer by cycling the load applied to the pipe; and expanding at least a portion of the expandable liner with the expansion cone while the actuator is in the disarmed position.

12. The method of claim 11 wherein the carrier includes a collet and a support ring, and wherein the actuator includes castellated rings and a shear pin.

* * * * *